US009635923B2

(12) United States Patent
Bitoh

(10) Patent No.: US 9,635,923 B2
(45) Date of Patent: May 2, 2017

(54) DRAWING APPARATUS AND CONTROL METHOD FOR DRAWING WITH DRAWING APPARATUS

(71) Applicant: CASIO COMPUTER CO., LTD., Shibuya-ku (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/616,053

(22) Filed: Feb. 6, 2015

(65) Prior Publication Data

US 2015/0216284 A1 Aug. 6, 2015

(30) Foreign Application Priority Data

Feb. 6, 2014 (JP) ..... 2014-020914

(51) Int. Cl.
*G06K 15/22* (2006.01)
*A45D 29/00* (2006.01)

(52) U.S. Cl.
CPC ..... *A45D 29/00* (2013.01); *A45D 2029/005* (2013.01)

(58) Field of Classification Search
CPC ..... A45D 34/04; A45D 29/00
See application file for complete search history.

(56) References Cited

U.S. PATENT DOCUMENTS 4,441,109 A * 4/1984 Fujisawa ..... B41J 2/49 346/139 R
4,517,576 A * 5/1985 Sugawara ..... B41J 2/49 346/139 B
4,533,924 A * 8/1985 Takahashi ..... B41J 2/49 346/139 R
4,560,996 A * 12/1985 Aratsu ..... B41J 2/49 346/136
4,754,288 A * 6/1988 Lawrence ..... B43L 13/024 346/139 R
4,779,104 A * 10/1988 Lawrence ..... B43L 13/024 235/456
4,849,771 A * 7/1989 Lawrence ..... B43L 13/024 235/456
4,933,876 A * 6/1990 Markoff ..... G01D 15/16 346/139 R
5,163,121 A * 11/1992 Hosler ..... G06K 15/22 358/1.3
5,477,023 A * 12/1995 Schneider ..... B23K 26/10 219/121.11

(Continued)

FOREIGN PATENT DOCUMENTS

JP 2013-212326 10/2013

*Primary Examiner* — Ted Barnes
(74) *Attorney, Agent, or Firm* — Cozen O'Connor

(57) ABSTRACT

A drawing apparatus includes a drawing head to hold at least one drawing tool which performs drawing by applying photocurable fluid material to a drawing target surface of a drawing target object, a light source unit which emits irradiation light including specific light in a specific wavelength region to cure the photocurable fluid material, and a light-blocking member which is disposed between the light source unit and the drawing tool held in the drawing head and blocks the specific light from arriving at the drawing tool when the light source unit emits the irradiation light.

6 Claims, 12 Drawing Sheets

(56) References Cited

U.S. PATENT DOCUMENTS 6,350,071 B1 * 2/2002 Conwell ..... B41J 2/325 347/102
7,370,955 B2 * 5/2008 Yokoyama ..... B41J 11/002 347/100
2002/0182339 A1 * 12/2002 Taylor ..... C08F 283/10 427/510
2003/0234848 A1 * 12/2003 Ishikawa ..... B41J 2/2117 347/102
2004/0113971 A1 * 6/2004 Nakajima ..... B41J 11/002 347/29
2004/0129158 A1 * 7/2004 Figov ..... B41C 1/003 101/401.1
2006/0055728 A1 * 3/2006 Nishino ..... B41J 2/17596 347/30
2006/0075914 A1 * 4/2006 Kawano ..... B41F 23/0406 101/424.1
2007/0221082 A1 * 9/2007 Fukui ..... B41J 2/2107 101/463.1
2008/0184930 A1 * 8/2008 Furukawa ..... B41J 11/002 118/46
2008/0199230 A1 * 8/2008 Kawano ..... B41F 23/0406 399/322
2008/0204536 A1 * 8/2008 Suzuki ..... B41J 11/002 347/102
2009/0033727 A1 * 2/2009 Anagnostopoulos ..... B41J 2/02 347/90
2009/0091590 A1 * 4/2009 Okamoto ..... B41J 11/0015 347/2
2009/0174908 A1 * 7/2009 Asai ..... B41J 2/2114 358/3.06
2010/0242753 A1 * 9/2010 Gygi ..... B41F 15/12 101/116
2010/0266794 A1 * 10/2010 Wright ..... A61L 15/60 428/35.7
2011/0104391 A1 * 5/2011 Miyamoto ..... B41J 11/0005 427/512
2011/0177518 A1 * 7/2011 Kartalov ..... C12N 13/00 435/6.12
2011/0298877 A1 * 12/2011 Blessing ..... B29D 11/00 347/102
2012/0086930 A1 * 4/2012 Kim ..... G03F 7/7055 355/53
2013/0182021 A1 * 7/2013 Vilk ..... B41J 2/2117 347/5
2013/0210646 A1 * 8/2013 Kartalov ..... C12Q 1/686 506/7
2014/0042341 A1 * 2/2014 Park ..... B05D 3/067 250/492.1
2014/0253633 A1 * 9/2014 Kobayashi ..... B41J 2/16535 347/33
2014/0253634 A1 * 9/2014 Kobayashi ..... B41J 2/16538 347/33
2015/0038379 A1 * 2/2015 Kartalov ..... C12N 13/00 506/40
2015/0059600 A1 * 3/2015 Heidrich ..... B41F 17/28 101/36
2016/0167399 A1 * 6/2016 Ohnishi ..... B41J 2/01 347/102

* cited by examiner

DRAWING APPARATUS AND CONTROL METHOD FOR DRAWING WITH DRAWING APPARATUS

CROSS-REFERENCE TO RELATED APPLICATIONS

This application is based upon and claims the benefit of priority from the prior Japanese Patent Application No. 2014-020914, filed on Feb. 6, 2014, the entire contents of which are incorporated herein by reference.

BACKGROUND OF THE INVENTION

1. Field of the Invention

The present invention relates to a drawing apparatus and a control method for drawing with a drawing apparatus.

2. Description of the Related Art

Gel photocurable resin (photocurable fluid material) has been known as resin to be applied to nails for nail arts at nail salons. The photocurable resin is cured by being irradiated with light in a specific wavelength region.

Nail arts created with such photocurable resin have more lucidity, gloss, and three-dimensional appearance than those created with normal ink and have a beautiful finish. In addition, such photocurable resin is difficult to come off after being cured, allowing nail arts to be durable.

When such photocurable resin is applied to nails, the nails with the photocurable resin need to be irradiated with light in a specific wavelength region to be cured.

In a conventional method, a resin curing device to cure photocurable resin is separately provided. After photocurable resin has been applied to a nail for drawing, the finger having the nail with the photocurable resin is put in a light irradiation device for curing resin. The nail with the photocurable resin is irradiated with light in a specific wavelength region so that the photocurable resin is cured.

Such a resin curing device is disclosed in, for example, Japanese Unexamined Patent Application Publication No. 2013-212326. This document discloses irradiation of a nail having a photocurable-resin nail art with light in a predetermined wavelength region to cure the photocurable resin.

Drawing apparatuses to draw nail designs on nails have been developed. If such a drawing apparatus applies photocurable resin to nails, nail arts having a lucidity, gloss, and three-dimensional appearance and having a beautiful finish can be created easily at home.

A nail with applied photocurable resin needs to be irradiated with light in a specific wavelength region for the applied photocurable resin to be cured, and there is a need for preparing a resin curing device separately from a drawing apparatus. A finger with the nail, to which the resin has been applied, is inserted in the resin curing device and irradiated after drawing is performed by the drawing apparatus. The process is thus troublesome.

In the case in which a drawing apparatus for drawing a nail design on the nail of one finger is used for the nails of multiple fingers, a user has to move fingers back and forth between the drawing apparatus and a resin curing device, leading to low work efficiency.

Moreover, uncured resin might touch other fingers or the devices when fingers are inserted in or pulled out of the devices, and the resin might come off or might be damaged. There is a risk therefore that the user might have to perform the drawing over again.

BRIEF SUMMARY OF THE INVENTION

The present invention provides a drawing apparatus and a control method for drawing with a drawing apparatus that can perform drawing on a drawing target surface by applying photocurable fluid material to the drawing target surface and cure the applied photocurable fluid material in a single apparatus in continuity.

According to a first aspect of the present invention, there is provided a drawing apparatus including: a drawing head to hold at least one drawing tool which performs drawing by applying photocurable fluid material to a drawing target surface of a drawing target object; and a light irradiation mechanism which irradiates the photocurable fluid material with irradiation light including light in a specific wavelength region to cure the photocurable fluid material, wherein the light irradiation mechanism includes: a light source unit to emit the irradiation light; and a light-blocking member which is disposed between the light source unit and the drawing tool and blocks the light in the specific wavelength region from reaching the drawing tool when the light source unit emits the irradiation light.

According to a second aspect of the present invention, there is provided a control method for drawing with a drawing apparatus, the method including: holding at least one drawing tool with a drawing head of the drawing apparatus, the drawing tool performing drawing with photocurable fluid material; performing the drawing on a drawing target surface of a drawing target object by applying the photocurable fluid material to the drawing target surface with the drawing tool; irradiating the photocurable fluid material applied to the drawing target surface with irradiation light including light in a specific wavelength region to cure the photocurable fluid material with a light source unit included in the drawing apparatus; and allowing a light-blocking member to be disposed between the light source unit and the drawing tool to block the light in the specific wavelength region from reaching the drawing tool when the light source unit emits the irradiation light.

BRIEF DESCRIPTION OF THE SEVERAL VIEWS OF THE DRAWING

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE INVENTION

Figure 1:
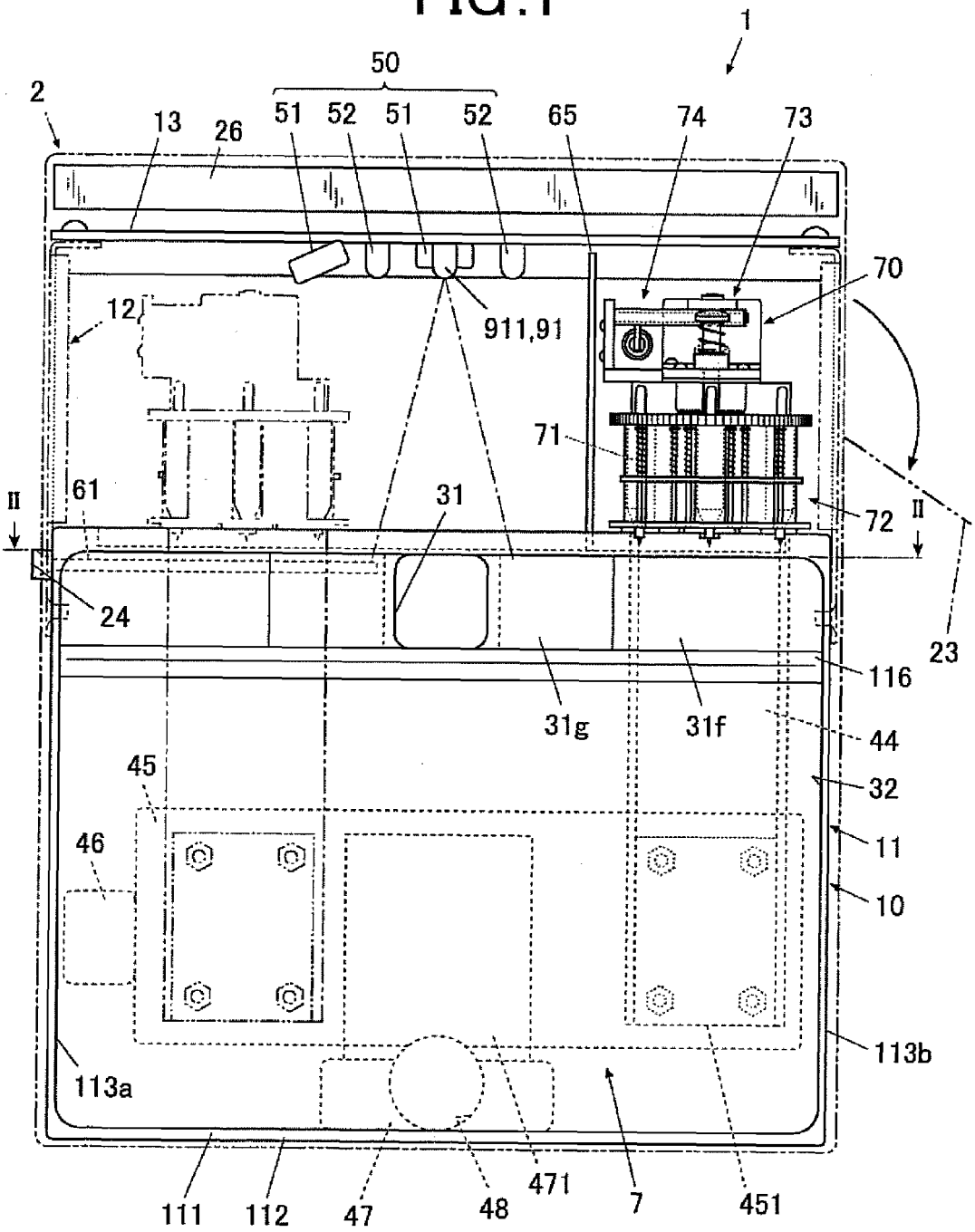
FIG. 1 is a front view of a drawing apparatus in a first embodiment.

Embodiments of a drawing apparatus and a control method for drawing with the drawing apparatus according to the present invention will now be described in detail with reference to the drawings.

The embodiments described below have various limitations which are technically preferable to carry out the present invention. The scope of the present invention, however, is not limited to the embodiments below and the examples shown in the drawings.

The drawing apparatuses of the embodiments perform drawing on the nail surface (drawing target surface) of a finger (drawing target object). The drawing target object of the present invention, however, is not limited to a finger, and the drawing target surface is not limited to the nail surface of a finger. A toe may be the drawing target object, and the nail surface of a toe may be the drawing target surface.

First Embodiment

A drawing apparatus 1 of a first embodiment of the present invention will now be described with reference to FIGS. 1 to 4.

FIG. 1 is a front view of the drawing apparatus 1 showing the internal configuration of the drawing apparatus 1.

Figure 2B:
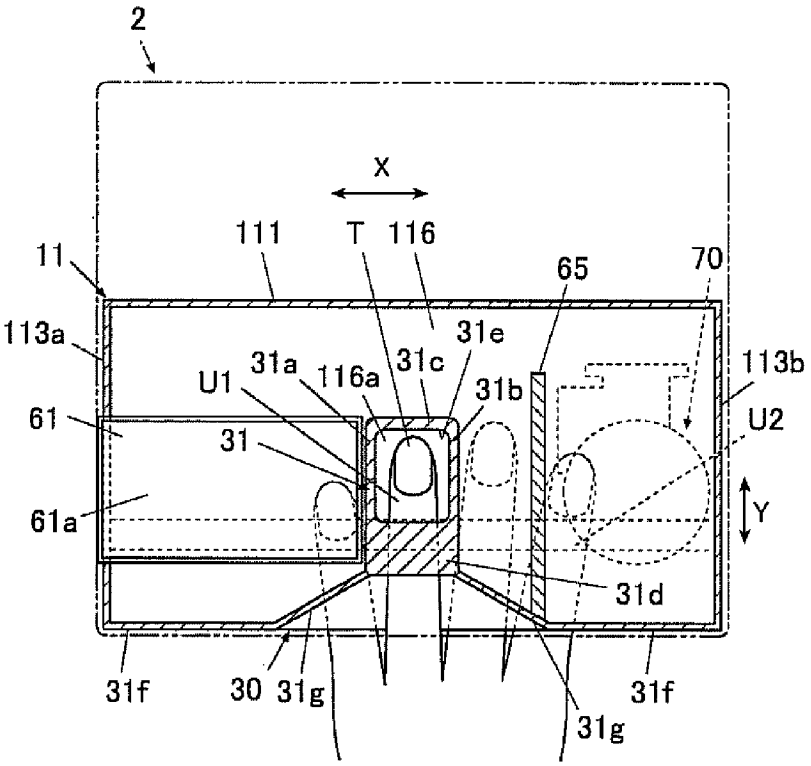
FIG. 2B is a sectional view along the line II-II of FIG. 1.
Figure 2A:
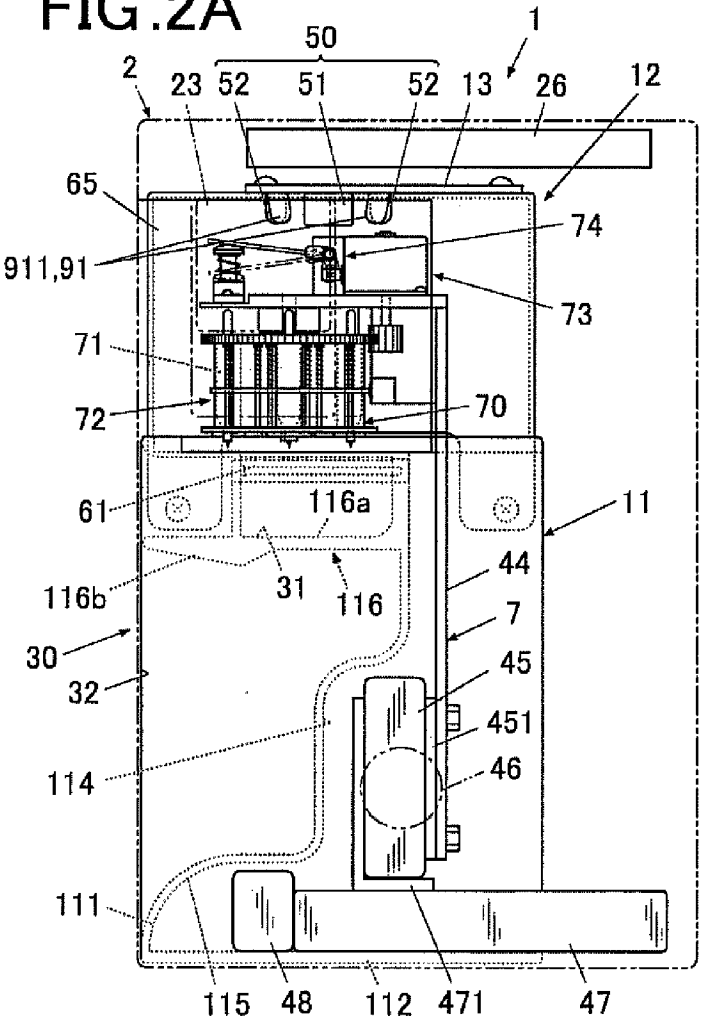
FIG. 2A is a side view of the drawing apparatus of 1, a part of which is shown in section to describe the internal configuration.

FIG. 2A is a side view of the drawing apparatus 1 of FIG. 1, a part of which is shown in section to describe the internal configuration.

FIG. 2B is a sectional view along the line II-II of FIG. 1.

As shown in FIGS. 1, 2A and 2B, the drawing apparatus 1 of this embodiment is a plotter drawing apparatus including a drawing head 70 with pens 71 to perform drawing on the nails T of printing fingers U1.

The drawing apparatus 1 includes a case body (casing) 2 and an apparatus body 10 contained in the case body 2.

A cover 23 for pen replacement is disposed at one end of the upper part of the lateral face of the case body 2. The cover 23 can be opened and closed so that a pen (drawing tool) 71 of a drawing unit 7, described later, can be replaced. The cover 23 for pen replacement can turn about a hinge, for example, from a closing state to an opening state as shown in FIG. 1.

One lateral face (the left face in FIG. 1 in this embodiment) of the case body 2 has a medium insertion/output opening 24 at the position corresponding to a pen warm-up section 61, which is described later. A drawing medium (not shown) placed on the pen warm-up section 61 can be replaced through the medium insertion/output opening 24.

An operation unit 25 (see FIG. 4) is disposed on the upper surface (top board) of the case body 2.

The operation unit 25 is an input unit to receive various inputs from a user.

The operation unit 25 includes operation buttons (not shown) for various inputs, such as an electrical power switch button to power on the drawing apparatus 1, a stop switch button to stop its operation, a design selection button to select a design image to be drawn on nails T, and a drawing start button to instruct start of drawing.

A display unit 26 is disposed on the upper surface (top board), almost in its center, of the case body 2.

The display unit 26 is constituted of a liquid crystal display (LCD), an organic electroluminescence display (organic EL), or another flat-panel display.

In the present embodiment, the display unit 26 displays nail images obtained by photographing a printing finger U1 (i.e., finger images each including the image of nail T), the image of the outline of the nail T included in the nail images, a design selection screen for selecting a design image to be drawn on a nail T, a thumbnail image for checking a design, an instruction screen to provide various instructions, and the like, as appropriate.

A touch panel for various inputs may be integrally formed on the surface of the display unit 26.

The apparatus body 10, which is substantially formed in the shape of a box, includes a lower machine casing 11 disposed at the lower part in the case body 2, and an upper machine casing 12 disposed above the lower machine casing 11 and at the upper part in the case body 2.

The lower machine casing 11 will now be described.

The lower machine casing 11 includes a back plate 111, a bottom plate 112, a pair of side plates 113*a* and 113*b*, an X-direction movement stage storage part 114, a Y-direction movement stage storage part 115, and a dividing wall 116.

The lower ends of the side plates 113*a* and 113*b* are connected to the both ends of the bottom plate 112, respectively, so that the side plates 113*a* and 113*b* are upright with respect to the bottom plate 112.

The lower part of the back plate 111 is caved in in two steps toward the front (i.e., the near side in the finger insertion direction) to form recesses.

The back plate 111, the bottom end of which is connected to the front end of the bottom plate 112, partitions the space enclosed by the bottom plate 112 and the side plates 113*a* and 113*b* into a front space and a back space.

The recessed spaces formed at the back of the back plate 111 are the X-direction movement stage storage part 114 and the Y-direction movement stage storage part 115 (see FIG. 2A).

An X-direction movement stage 45 of a drawing unit 7 fits in the X-direction movement stage storage part 114 when the drawing unit 7 moves forward (i.e., to the near side in the finger insertion direction).

A Y-direction movement stage 47 of the drawing unit 7 is disposed in the Y-direction movement stage storage part 115.

The dividing wall 116 is disposed in the lower machine casing 11 so as to vertically partition the front space inside the lower machine casing 11 (i.e., the space on the near side in the finger insertion direction enclosed by the back plate 111, the bottom plate 112 and the side plates 113*a* and 113*b*).

The dividing wall 116 lies substantially horizontally so that the left and right ends of the dividing wall 116 are connected to the side plates 113*a* and 113*b*, respectively, and so that the rear end of the dividing wall 116 is connected to the back plate 111.

The lower machine casing 11 is provided with a finger fixation section 30 integrally (see FIG. 2A).

The finger fixation section 30 is constituted of a finger receiving section 31 and a finger escape section 32. The finger receiving section 31 is a section to receive a finger U1 with a nail T on which a drawing is to be performed (i.e., a drawing target object, which is referred to as a "printing finger U1", hereinbelow), and the finger escape section 32 is a section where fingers U2 other than the printing finger U1 ("non-printing fingers U2", hereinbelow) are inserted.

The finger receiving section 31 is disposed over the dividing wall 116 and almost at the center of the lower machine casing 11 in the width direction.

The lower space, formed by the dividing wall 116, of the lower machine casing 11 constitutes the finger escape section 32.

For example, when a drawing is to be performed on the nail T of a ring finger, the ring finger as a printing finger U1 is inserted in the finger receiving section 31, while the other four fingers (i.e., the thumb and index, middle, and little fingers) as non-printing fingers U2 are inserted in the finger escape section 32.

The finger receiving section 31 opens toward the front side (i.e., the near side in the printing finger insertion direction) of the lower machine casing 11 and is defined by a finger placement section 116*a* at the bottom which constitutes a part of the dividing wall 116, partitions 31*a* at the both sides, and a partition 31*c* at the back. The finger placement section 116*a* allows a finger (printing finger U1) with a drawing target nail T to be placed on an X-Y plane (placement surface).

The finger receiving section 31 is defined by a ceiling 31*d* at the top.

The ceiling 31*d* has an exposing window 31*e* in its upper surface through which the nail T of a printing finger U1 inserted in the finger receiving section 31 is exposed.

A front wall 31*f* which covers the front both-side parts of the lower machine casing 11 stands upright on the upper surface of the dividing wall 116 (see FIG. 1).

A pair of guide walls 31*g* to guide a printing finger U1 into the finger receiving section 31 stands upright on the upper surface of the dividing wall 116. The guide walls 31*g* narrow from the end near, the center of the front wall 31*f* toward the finger receiving section 31 (see FIG. 1).

The dividing wall 116 can be held between a printing finger U1 inserted in the finger receiving section 31 and non-printing fingers U2 inserted in the finger escape section 32 by a user. Thus, a printing finger U1 inserted in the finger receiving section 31 can be stably fixed.

In this embodiment, the dividing wall 116 is provided with a bulge 116*b* bulging downward at the front end portion of the dividing wall 116. The bulge 116*b* may form a taper portion whose thickness gradually decreases toward the near side and gradually increases toward the back. Alternatively, the entire thickness of the bulge 116*b* may be larger than that of the back part of the dividing wall 116.

A pen warm-up section 61 is provided on the upper surface of the lower machine casing 11 beside the finger receiving section 31 (i.e., at the position corresponding to the medium insertion/output opening 24 of the case body 2, which is on the left side in FIG. 1 in this embodiment). The pen warm-up section 61 allows warm-up drawing of pens 71 (described later) on an area over which a drawing head 70 (described later) can perform drawing.

Preferably, a part of the upper surface of the lower machine casing 11 is recessed to form the pen warm-up section 61, and the pen warm-up section 61 is substantially the same level as the nail T of a printing finger U1 inserted in the finger receiving section 31.

The pen warm-up section 61 is a flat part on which a drawing medium (not shown) inserted through the medium insertion/output opening 24 of the case body 2 is placed.

Anything that enables warm-up (breaking-in) of the pen tip portions 713 of the pens 71 may be used as a drawing medium to be placed on the pen warm-up section 61. For example, a slip of paper may be used.

The pen tip portion 713 of a pen 71 without the warm-up drawing is sometimes drying and has a bad spread of ink, leading to fuzzy and uneven lines at the beginning of the drawing.

The pen warm-up section 61 is used for warm-up drawing to bring the pen tip portions 713 in good condition before the start of regular drawing based on image data on a nail T. Specifically, in the warm-up drawing, each pen 71 is carried down to a drawing medium to draw predetermined figures, such as "○" and "∞". This prevents fuzzy and uneven lines at the beginning of the drawing.

A light-blocking wall 65 is disposed on the upper surface of the lower machine casing 11 and beside the finger receiving section 31.

As shown in FIG. 2B, the light-blocking wall 65 of this embodiment is disposed on the upper surface of the lower machine casing 11 and opposite to the pen warm-up section 61 (i.e., the right side in FIG. 2B) at the near side of the apparatus (i.e., the left side in FIG. 2A).

The light-blocking wall 65 is a light-blocking member that is disposed between a light irradiation mechanism 91 and the pens 71 to block the light from the light irradiation mechanism 91 from arriving at the pens 71 at least while a nail T is being irradiated by the light irradiation mechanism 91.

A movement mechanism to move the pen carriage 72 allows the pens 71 to be at a drawing position, where the pens 71 can perform drawing on the surfaces of nails T, and an escape position, where the light-blocking wall 65 is disposed between the light irradiation mechanism 91 and the pens 71 as shown in FIG. 2B, as described later.

Light in a specific wavelength region (e.g., ultraviolet (UV) light or approximate UV light in this embodiment) included in the light (irradiation light) emitted from the light irradiation mechanism 91 does not pass through the light-blocking wall 65 but is reflected or absorbed by the light-blocking wall 65. The light-blocking wall 65 thereby blocks the light in the specific wavelength region from arriving at the pens 71 at the escape position. The light-blocking wall 65 is made of, for example, resin material.

The light-blocking wall 65 may have any configuration and may be made of any material as long as it can block light in a specific wavelength region included in the light from the light irradiation mechanism 91 from arriving at the pens 71.

The shape and position of the light-blocking wall 65 is also not limited to the example shown in the drawings.

For example, FIGS. 1 and 2A show a case in which there is a space between the light-blocking wall 65 and the substrate 13, but the upper end of the light-blocking wall 65 may be in contact with the substrate 13.

FIG. 2B shows a case in which the light-blocking wall 65 is a plate. Alternatively, the light-blocking wall 65 may have an L shape in a top view so as to surround the escape position.

The light-blocking wall 65 may be disposed on the same side as the pen warm-up section 61 (i.e., the left side in FIG. 2B).

In this case, the pens 71 may perform warm-up drawing to be ready for the subsequent drawing while the light irradiation mechanism 91 is irradiating a nail T.

The environmental light coming in the case body 2 from outside includes, for example, sunlight and may include the light in the specific wavelength region (e.g., UV light or approximate UV light). Accordingly, the case body 2 is preferably made of material equivalent to that of the light-blocking member, which does not let the light in the specific wavelength region included in the environmental light pass through but reflects or absorbs such light.

The drawing unit 7 includes the drawing head 70 having pens 71 for drawing, a unit support member 44 to support the drawing head 70, the X-direction movement stage 45 to move the drawing head 70 in the X direction (i.e., the X direction in FIG. 1 or the right-left direction of the drawing apparatus 1), an X-direction movement motor 46, the Y-direction movement stage 47 to move the drawing head 70 in the Y direction (i.e., the Y direction in FIG. 2B or the front-back direction of the drawing apparatus 1), and a Y-direction movement motor 48.

Figure 3A:
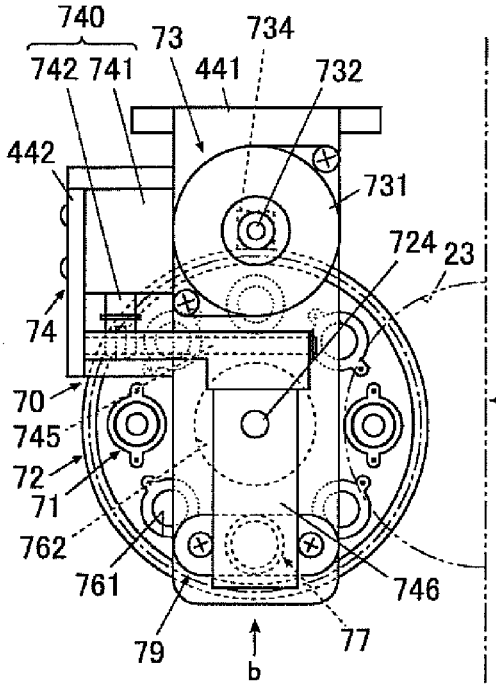
FIG. 3A is a top view of a drawing head in the first embodiment.

FIG. 3A is a top view of the drawing head 70.

Figure 3C:
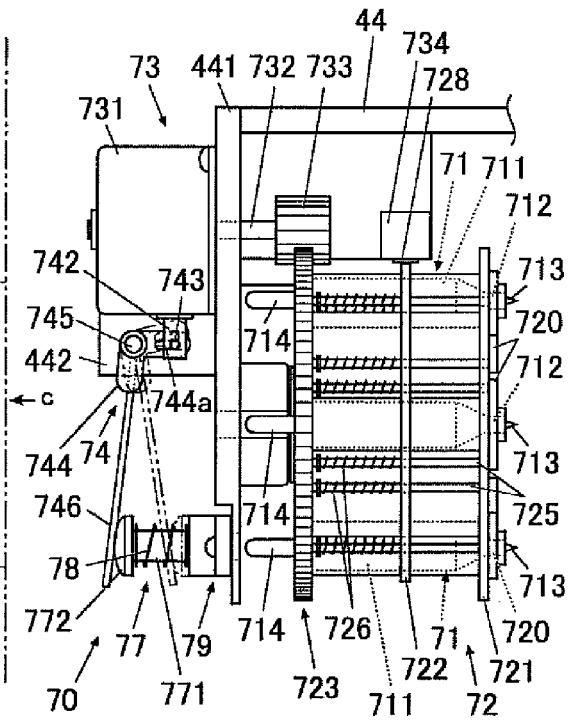
FIG. 3C is a side view of the drawing head, seen from the direction of arrow c of FIG. 3A.
Figure 3B:
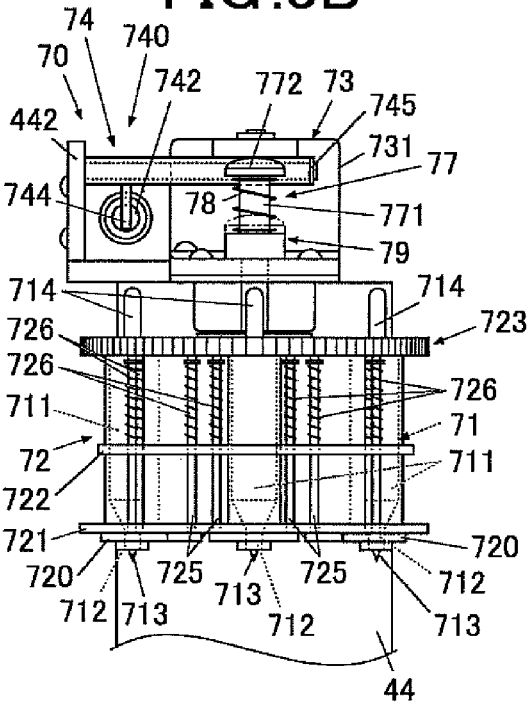
FIG. 3B is a front view of the drawing head, seen from the direction of arrow b of FIG. 3A.

FIG. 3B is a front view of the drawing head 70, seen from the direction of arrow b of FIG. 3A.

FIG. 3C is a side view of the drawing head 70, seen from the direction of arrow c of FIG. 3A.

As shown in FIGS. 3A to 3C, the drawing head 70 of this embodiment includes a rotary pen carriage 72 that can hold a plurality of pens 71, a carriage rotating mechanism 73 to rotate the pen carriage 72, and a pen pressing mechanism 74 to carry a pen 71 held by the pen carriage 72 up and down.

The upper end of the unit support member 44 is a beam part 441 extending toward the near side of the drawing apparatus 1 (i.e., the left side in FIG. 2A) to form an L shape. The drawing head 70 is disposed on the beam part 441.

The pen carriage 72 of this embodiment includes three plate members 721 to 723 (i.e., a first plate member 721, a second plate member 722, and a third plate member 723), pen tip fixing members 720, a rotation shaft 724, auxiliary shaft members 725, coil springs 726, pen cylindrical members 761, and a rotation-shaft cylindrical member 762.

The three plate members 721 to 723 (the first plate member 721, the second plate member 722, and the third plate member 723) are disk-shaped members having substantially the same size. The first plate member 721, the second plate member 722, and the third plate member 723 are disposed in this order from the bottom.

The third plate member 723 disposed at the top is provided with teeth on the outer periphery of the third plate member 723 to engage a gear 733 of the carriage rotating mechanism 73, and serves as a gear.

A reference mark 728 to indicate a reference position for the rotation of the pen carriage 72 is provided at a predetermined position (e.g., the position corresponding to a certain pen cylindrical member 761) on the outer periphery of the second plate member 722.

The reference mark 728, which is constituted of a reflecting cloth or a reflecting sheet to be read by an optical sensor, is fixed (e.g., pasted) to the outer periphery of the second plate member 722 in this embodiment.

The pen carriage 72 has eight pen cylindrical members 761 to hold pens 71 along its periphery. The top and bottom of each pen cylindrical member 761 are open. FIG. 3A illustrates a case in which four of the eight pen cylindrical members 761 hold pens 71.

In this embodiment, each of the three plate members 721 to 723 has through-holes at the positions corresponding to the pen cylindrical members 761. The pen cylindrical members 761 pass through the through-holes in such as way as to penetrate the three plate members 721 to 723.

Through-holes for auxiliary shafts through which the auxiliary shaft members 725 pass are provided at both sides of each through-hole for pen in the first and second plate members 721 and 722.

The pen tip fixing members 720 are disposed under the first plate member 721 so as to cover the openings at the bottom of the pen cylindrical members 761.

The pen tip fixing members 720 are fixing members to fix the tip portions of the pen shafts 711 of pens 71 (drawing tools).

The lower end part of each auxiliary shaft member 725 fits in a pen tip fixing member 720. The auxiliary shaft member 725 is fixed to be parallel to the pen shaft 711 of a pen 71 and moves up and down together with the pen 71.

Each of the pen tip fixing members 720 has a through-hole 720*a* almost in its center. A fit part 712 of a pen 71, described later, is to be inserted and fits in the through-hole 720*a*.

Each auxiliary shaft member 725 passes through the through-hole for auxiliary shaft in the first and second plate members 721 and 722.

Each auxiliary shaft member 725 is provided with an E-ring 727 near its top end. The E-ring 727 protrudes outward.

The external diameter of the E-ring 727 is larger than the internal diameter of the through-hole for auxiliary shaft in the second plate member 722.

The coil spring 726 is wound around each auxiliary shaft member 725 at the outer periphery of a pen 71. The coil spring 726 is provided between the E-ring 727 and the upper surface of the second plate member 722.

The coil spring 726, which is a biasing member for the auxiliary shaft, biases the auxiliary shaft member 725 upward when an external force is not applied.

In a non-drawing state, the coil spring 726 holds the pen 71 at such a position that the pen tip portion 713 does not touch a nail T. Specifically, the upper end parts of the auxiliary shaft members 725 are held at a position close to the lower surface of the third plate member 723 when an external force is not applied. In this state, the pen tip portion 713 is disposed close to the lower surface of the first plate member 721 and does not touch a nail T even if the pen carriage moves over the finger receiving section 31.

Each of the three plate members 721 to 723 has a through-hole almost in the center.

The rotation-shaft cylindrical member 762 passes through the center through-hole so as to penetrate the three plate members 721 to 723.

The rotation shaft 724, which extends vertically from the beam part 441, passes through the rotation-shaft cylindrical member 762. The pen carriage 72 is rotatable substantially horizontally about the rotation shaft 724.

The pens 71 are each a drawing tool whose tip portion touches the surface of a nail T (i.e., drawing target surface) to perform drawing on the drawing target surface.

The pen (drawing tool) 71 of this embodiment includes a rod-like pen shaft 711 with a pen tip portion 713 at its end portion.

The pen shaft 711 has a fit part 712 at its end part. The fit part 712 has a diameter smaller than that of the pen shaft 711.

The fit part 712 is a part to fit into a recess 720*b* of the pen tip fixing member 720. Fitting the fit part 712 into the recess 720*b* allows the pen tip portion 713 to be firmly fixed, preventing the pen tip portion 713 from being unsteady.

Each pen shaft 71 has a rod-like protrusion 714 at its top.

The protrusion 714 is a part to be pressed by a sliding pin 77 which is described later.

The protrusion 714 also serves as a tab to be pinched with fingers etc. when a user takes the pen 71 to replace it, for example.

The interiors of the pen shafts 711 serve as ink containers to contain various types of inks.

Various types of inks may be applied as the ink contained in the pen shafts 711.

The viscosity of ink and particle size (or particle diameter) of coloring material are not particularly limited. For example, ink containing gold and silver glitter, white ink, undercoats, topcoats, and nail polish may be used as the ink.

In this embodiment, the pen shaft 711 of at least one of the plurality of pens 71 held by the plurality of pen cylindrical members 761 of the pen carriage 72 contains photocurable fluid material as the ink.

The photocurable fluid material is a material to be polymerized and cured when irradiated with light in a specific wavelength region.

In this embodiment, the photocurable fluid material is a UV curable gel ink (e.g., UV curable acrylic resin for gel nails) to be cured with ultraviolet rays.

The photocurable fluid material, however, is not limited to the example shown here.

The photocurable fluid material may be inks to be cured with approximate UV light, visible light, or light of a plurality of wavelengths, for example.

In this embodiment, the pens 71 each have a pen tip portion 713 of a ballpoint-pen type, for example, which allows the ink in the pen shaft 711 to come out through the pen tip portion 713 pressed against the surface of a nail T for drawing.

The pens 71 are not limited to such ballpoint-type pens.

The pens 71 may be fiber-type pens which allow the ink to ooze through the resin or felt pen tip portions for drawing, or brush-type pencils which have bundle of hair and perform drawing with the hair soaked with the ink.

The pen tip portions 713 may have various thicknesses.

The types of the pen tip portions 713 of the plurality of pens 71 held by the plurality of pen cylindrical members 761 of the pen carriage 72 may be the same as or different from one another.

Each pen 71 is held by the pen cylindrical member 761 of the pen carriage 72, with the pen 71 just inserted into the pen cylindrical member 761 from above. The pen 71 thus can be easily taken out from the pen cylindrical member 761 to be replaced by a user opening the cover 23 for pen replacement of the case body 2 and pinching the protrusion 714 with fingers or tweezers, for example.

As shown in FIG. 3C, the carriage rotating mechanism 73 includes a step motor 731 and a gear 733 that is connected to the step motor 731 through a rotation shaft 732 and is engaged with the gear 723 of the pen carriage 72.

In this embodiment, when the step motor 731 is driven to rotate the rotation shaft 732 and the gear 733 attached to the rotation shaft 732, the gear 723 of the pen carriage 72 engaged with the gear 733 rotates. The pen carriage 72 thus rotates rightward and leftward.

The pen pressing mechanism 74, which includes a pressing elastic member, presses down a pen (drawing tool) 71 held by the pen cylindrical member 761 of pen carriage 72.

In this embodiment, the pen pressing mechanism 74 includes a solenoid 740 having a plunger 742 and a coil 741, a pin 743 attached to the moving end part of the plunger 742 of the solenoid 740, a plate spring up-and-down lever 744 whose one end is connected to the plunger 742 through the pin 743, a plate spring 746 attached to the other end of the plate spring up-and-down lever 744, the sliding pin 77, and a coil spring 78 wound around the sliding pin 77.

A support member 442 is disposed upright on the beam part 441, and the support member 442 is provided with a support shaft 745 extending orthogonally to the moving direction of the plunger 742.

As shown in FIG. 3C, the plate spring up-and-down lever 744 is substantially in the shape of an L in a side view, and the support shaft 745 passes through the intersection of the L shape of the plate spring up-and-down lever 744. The plate spring up-and-down lever 744 is rotatable about the support shaft 745.

The plate spring up-and-down lever 744 has a long hole 744*a* at the part connecting to the plunger 742. The pin 743 attached to the plunger 742 fits in the long hole 744*a*.

The plate spring 746 is fixed to the other end of the plate spring up-and-down lever 744.

The plate spring 746 is a pressing elastic member which can touch the top of the sliding pin 77 to press down the sliding pin 77 and a pen 71 in contact with the sliding pin 77, and which bends and deforms when pushed upward by the sliding pin 77 and a pen 71.

The plate spring 746 of this embodiment is a flat spring whose free end is disposed over the sliding pin 77.

The sliding pin 77 is movable vertically. The lower end of the sliding pin 77 touches the top of the pen body 710 when the sliding pin 77 is carried down.

The coil spring 78 is an elastic member to be compressed when the sliding pin 77 is pressed down by an external force and to have a restoring force against the external force.

The unit support member 44 is fixed to an X-direction movement section 451 attached to the X-direction movement stage 45. This allows the drawing head 70 attached to the unit support member 44 to move in the X direction (i.e., the X direction in FIG. 1 or the right-left direction of the drawing apparatus 1).

The X-direction movement stage 45 is fixed to a Y-direction movement section 471 of the Y-direction movement stage 47. This allows the drawing head 70 attached to the unit support member 44 to move in the Y direction (i.e., the Y direction in FIG. 2 or the front-back direction of the drawing apparatus 1).

In this embodiment, the X-direction movement motor 46, the Y-direction movement motor 48 and the like constitute a head drive section 49 as an X-Y drive section to move the drawing head 70 including the pens 71 for drawing on a nail T in the X and Y directions.

The solenoid 740 of the pen pressing mechanism 74 to move a pen 71 up and down, the step motor 731 to rotate the pen carriage 72, the X-direction movement motor 46, and the Y-direction movement motor 48 of the drawing unit 7 are connected to a drawing controller 815 of a control device 80 (see FIG. 4, described later) to be controlled by the drawing controller 815.

As shown in FIGS. 1 and 2A, the photographing unit 50 is disposed on the upper machine casing 12.

A substrate 13 is disposed on the upper machine casing 12, and two cameras 51 as photographing devices of the photographing unit 50 are disposed at the center of the lower surface of the substrate 13.

The cameras 51 are preferably compact cameras each including a solid image sensing element having about two million pixels or more and a lens.

The cameras 51 photograph the nail T of a printing finger U1 inserted in the finger receiving section 31 to obtain nail images (i.e., finger images each including the image of the nail T), which are the images of the nail T of the printing finger U1.

One of the two cameras 51 faces the bottom face of the finger receiving section 31 to photograph a nail T from just above.

The other of the two cameras 51 is slightly tilted to the bottom face of the finger receiving section 31 to photograph the nail T from diagonally above.

The substrate 13 is provided with illuminators (illuminating devices) 52, such as white LEDs, disposed in such a way as to surround the cameras 51. The illuminators 52 illuminate the nail T of a printing finger U1 when the cameras 51 photograph the nail T. The photographing unit 50 is constituted of the cameras 51 and the illuminators 52.

The photographing unit 50 is connected to a photographing controller 811 of the control device 80 (see FIG. 4, described later) to be controlled by the photographing controller 811.

The image data of images obtained by the photographing unit 50 is stored in a nail image storage area 821 of a storage unit 82, described later.

In this embodiment, two cameras 51 as photographing devices photograph a nail T from at least two different positions or angles to obtain at least two nail images. A nail information detector 812 (described later) detects nail information, such as the contour (shape) of a nail T, the curved shape of a nail T, and the vertical position of a nail T on the basis of the nail images.

In this embodiment, UV light sources (light source unit) 911 constituting the light irradiation mechanism 91 (see FIG. 4) are disposed near the illuminators 52 of the photographing unit 50.

The light irradiation mechanism 91 includes light sources to emit light (irradiation light) including light in a specific wavelength region to cure the photocurable fluid material applied to a nail T with pens (drawing tools) 71. The light irradiation mechanism 91 of this embodiment is constituted of, for example, two UV light sources 911 to emit ultraviolet rays.

The light from the light irradiation mechanism 91 is not limited to ultraviolet rays.

The light from the light irradiation mechanism 91 is determined appropriately in accordance with the type and nature of the photocurable fluid material contained in the ink containers of the pens (drawing tools) 71.

The light irradiation mechanism 91 may be able to emit light of a plurality of wavelengths.

Each of the UV light sources 911 of this embodiment is a light emitting diode (LED) to emit light of a wavelength region of ultraviolet rays or close to a wavelength region of ultraviolet rays. The UV light sources 911 are not limited to LEDs but may be any other light sources.

As shown in FIG. 1, the light from the UV light sources 911 irradiates the surface of a nail T or drawing target surface.

The light from the UV light sources 911 does not arrive at the right side of the light-blocking wall 65 in the drawing apparatus 1 (i.e., the right part in FIG. 1).

The angles of the UV light sources 911 are preferably adjusted so that the area to be irradiated by the UV light sources 911 is as small as possible and is limited to the surface of a nail T and its neighborhood.

The control device 80 is disposed on the substrate 13 on the upper machine casing 12, for example.

Figure 4:
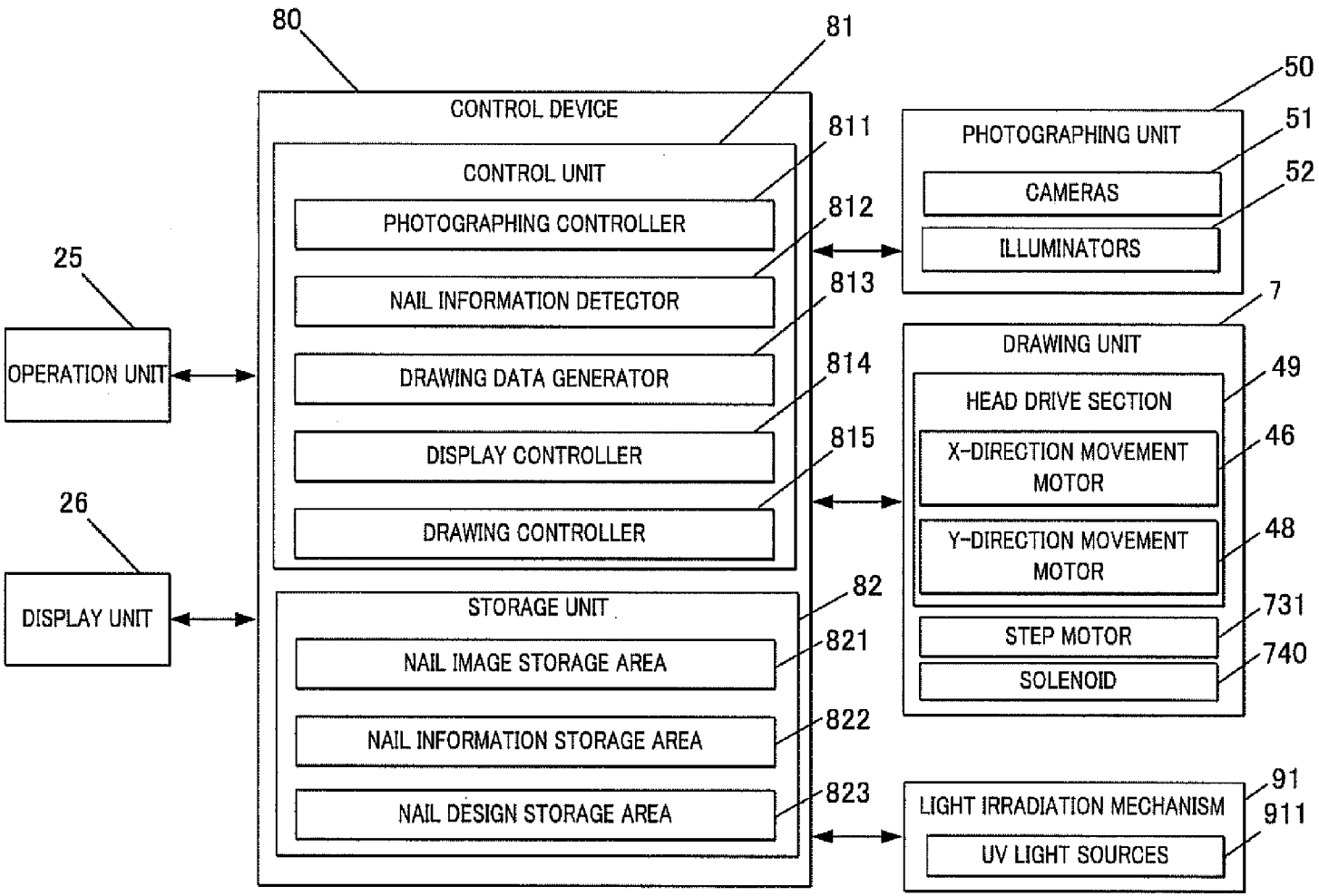
FIG. 4 is a block diagram showing the principal control configuration of the drawing apparatus according to the embodiment.

FIG. 4 is a block diagram showing the principal control configuration in this embodiment.

As shown in FIG. 4, the control device 80 is a computer including a control unit 81 constituted of a central processing unit (CPU), and a storage unit 82 constituted of a read only memory (ROM) and a random access memory (RAM), for example (the CPU, ROM and RAM are not shown).

The storage unit 82 contains various programs and various pieces of data for the operation of the drawing apparatus 1.

Specifically, the ROM of the storage unit 82 contains various programs, such as a nail information detection program to detect nail information, such as the shape and contour of a nail T, from nail images; a drawing data generation program to generate drawing data; and a drawing program to perform drawing processing. Each unit of the drawing apparatus 1 is comprehensively controlled through the execution of these programs by the control device 80.

In this embodiment, the storage unit 82 includes a nail image storage area 821, a nail information storage area 822, and a nail design storage area 823. The nail image storage area 821 stores nail images of the nail T of a user's printing finger U1 obtained by the photographing unit 50. The nail information storage area 822 stores the nail information (including the contours and inclination angles of nails T) detected by the nail information detector 812. The nail design storage area 823 stores the image data of nail designs to be drawn on nails T.

The control unit 81 includes the photographing controller 811, the nail information detector 812, the drawing data generator 813, the display controller 814, and the drawing controller 815, in terms of its function. The functions as the photographing controller 811, the nail information detector 812, the drawing data generator 813, the display controller 814, and the drawing controller 815 are carried out through cooperation between the CPU of the control unit 81 and the programs stored in the ROM of the storage unit 82.

The photographing controller 811 controls the cameras 51 and the illuminators 52 of the photographing unit 50 so that the cameras 51 take finger images each including the image of the nail T of a printing finger U1 inserted in the finger receiving section 31 (hereinafter referred to as "nail images").

In this embodiment, the photographing controller 811 allows the two cameras 51 to obtain at least two nail images from different positions or angles (e.g., from just above a nail T and diagonally above the nail T).

The image data of nail images obtained by the photographing unit 50 may be stored in the storage unit 82.

The nail information detector 812 detects the nail information on the nail T of a printing finger U1 on the basis of the images of the nail T of the printing finger U1 inserted in the finger receiving section 31 obtained by the cameras 51.

The nail information includes the information on the contour of a nail T (i.e., the shape or the horizontal position of a nail T), the height of a nail T (i.e., the position of a nail T in the vertical direction, hereinafter referred to as "vertical position of a nail T" or simply as "the position of a nail T"), and the inclination angle of the surface of a nail T to the X-Y plane (i.e., the inclination angle of a nail T or nail curvature).

The drawing data generator 813 generates drawing data to be applied to the nail T of a printing finger U1 by the drawing head 70 on the basis of the nail information detected by the nail information detector 812.

Specifically, the drawing data generator 813 performs a fitting process such as expansion or reduction in size or clipping of the image data of a nail design on the basis of the shape of a nail T detected by the nail information detector 812.

The drawing data generator 813 fits the image data of a nail design to the shape of a nail T and performs, for example, curved surface correction as appropriate in accordance with the nail information detected by the nail information detector 812.

The drawing data of a nail design to be applied to the nail T is thus generated.

The display controller 814 controls the display unit 26 to display various screens on the display unit 26. In this embodiment, the display controller 814 controls the display unit 26 to display a selection screen to allow selection of a nail design, a thumbnail image for confirmation of a design, nail images obtained by the photographing of a printing finger U1, and various instruction screens.

The drawing controller 815 outputs control signals based on the drawing data generated by the drawing data generator 813 to the drawing unit 7 and controls the solenoid 740 of the pen pressing mechanism 74, the step motor 731, the X-direction movement motor 46, and the Y-direction movement motor 48 of the drawing unit 7 to make a drawing based on the drawing data on a nail T.

In this embodiment, the drawing controller 815 controls the operation of the solenoid 740 in such a way that the solenoid 740 is not operated at a non-drawing time, while current is applied to the coil 741 of the solenoid 740 to pull the plunger 742 at a drawing time.

At the non-drawing time, the plate spring 746 does not press down the pin head 772 of the sliding pin 77 and the auxiliary shaft members 725 are biased upward by the coil springs 726, so that the pen 71 is kept at such a position that the pen tip portion 713 does not touch a nail T.

At the drawing time, the plate spring 746 presses down the pin head 772 of the sliding pin 77 and thereby the pen 71 is pressed down against the biasing force of the coil spring 726, so that the pen tip portion 713 is carried down to a position to touch a nail T.

In this way, the drawing controller 815 controls the operation of the solenoid 740 to move a pen 71 up and down as appropriate, and thereby a pen 71 freely moves along the ups and downs of a nail T while the pen tip portion 713 is applying a proper pen pressure. This enables drawing of a desired nail design on the surface of a nail T or drawing target.

In this embodiment, the drawing controller 815 controls the UV light sources 911 of the light irradiation mechanism 91 to turn on and off.

In a case in which the pens 71 contain photocurable fluid material for drawing, such as photocurable gel ink, the drawing controller 815 turns on the UV light sources 911 of the light irradiation mechanism 91 so as to cure the photocurable gel ink (photocurable fluid material) on a nail T after the drawing is performed with the pens 71.

Before turning on the UV light sources 911, the drawing controller 815 controls the X-direction movement motor 46 and Y-direction movement motor 48 to move the drawing head 70 (pen carriage 72) holding the pens 71 to the escape position at the right side of the light-blocking wall 65 in the apparatus.

Specifically, the drawing controller 815 first operates the Y-direction movement motor 48 to move the drawing head 70 (pen carriage 72) to the farthest place in the Y direction (i.e., the right side in FIG. 2A or the upper side in FIG. 2B).

The drawing controller 815 then operates the X-direction movement motor 46 to move the drawing head 70 (pen carriage 72) to the farthest place in the X direction (i.e., the right side in FIG. 1 or the right side in FIG. 2B).

The drawing controller 815 then operates the Y-direction movement motor 48 to move the drawing head 70 (pen carriage 72) to the near side in the Y direction (i.e., the left side in FIG. 2A or the lower side in FIG. 2B).

In this way, the drawing head 70 (pen carriage 72) passes the back of the light-blocking wall 65 and comes to the escape position, where the light-blocking wall 65 is between the drawing head 70 (pen carriage 72) and the UV light sources 911.

The operation and the control method for drawing of the drawing apparatus 1 in this embodiment will now be described.

When performing drawing with the drawing apparatus 1, a user first turns on the electrical power switch to start the control device 80.

The display controller 814 controls the display unit 26 to display the design selection screen.

The user operates an operation button of the operation unit 25, for example, and selects a desired nail design among a plurality of nail designs displayed on the design selection screen.

This causes the operation unit 25 to output a selection instruction signal so that a nail design to be drawn on a nail T is selected.

Upon selection of a nail design, the control unit 81 allows the display unit 26 to display an instruction screen urging a user to attach pens 71 required for drawing the selected nail design to predetermined pen cylindrical members 761 of the drawing head 70.

When red ink and gold ink containing glitter are needed, for example, the control unit 81 gives instructions through the display unit 26 about which pens 71 are to be attached to which pen cylindrical members 761.

A user attaches the specified types of pens 71 to the specified pen cylindrical members 761 in accordance with the instructions displayed on the screen.

A user may dare to attach pens 71 different from the instructions to produce a nail design with desired colors and texture.

Next, the user inserts a printing finger U1 in the finger receiving section 31 and inserts non-printing fingers U2 in the finger escape section 32 so as to fix the printing finger U1. The user then operates the drawing start button.

For example, when the left ring finger is inserted in the finger receiving section 31 as a printing finger U1, the other fingers are inserted in the finger escape section 32 as non-printing fingers U2.

Before the start of a drawing operation, the photographing controller 811 controls the photographing unit 50 so that the two cameras 51 photograph the printing finger U1 while the illuminators 52 illuminate the printing finger U1 in response to an instruction input from the drawing start button.

The photographing controller 811 thus obtains at least two images (nail images) of the nail T of the printing finger U1 inserted in the finger receiving section 31.

Next, the nail information detector 812 detects nail information, such as the contour (shape) and inclination angle (curvature) of the nail T on the basis of the nail images.

After the nail information detector 812 detects the contour (shape) and inclination angle (curvature) of the nail T as the nail information, the drawing data generator 813 performs the fitting process to fit the image data of the nail design to the nail T on the basis of the nail information.

The drawing data generator 813 then performs the curved surface correction on the image data of the nail design on the basis of the nail information. Thus, drawing data is generated.

Before the start of drawing on the nail T, the drawing controller 815 moves the drawing unit 7 to the position above the pen warm-up section 61. The drawing controller 815 drives the solenoid 740 of the pen pressing mechanism 74 to carry a pen 71 down with a plate spring 747 so that the pen 71 is ready for drawing.

Predetermined figures, such as "○" and "∞", are then drawn on a drawing medium for warm-up of the pens 71.

The warm-up drawing may be performed by only the pens 71 required to draw a selected nail design or alternatively may be performed by all the pens 71.

After the drawing data has been generated and the warm-up drawing has been completed, the drawing controller 815 outputs control signals based on the drawing data to the drawing unit 7 and allows the drawing head 70 to perform drawing based on the drawing data.

Specifically, the drawing controller 815 obtains the degree of rotation of the pen carriage 72 from the results of reading of the reference mark 728 by the mark reader 734 and controls the driving of the step motor 731 in accordance with the degree of rotation of the pen carriage 72. The drawing controller 815 thereby rotates the pen carriage 72 so that the pen 71 required for the drawing comes to the position of the pen pressing mechanism 74.

The drawing controller 815 further moves the drawing head 70 in the X and Y directions as appropriate to a drawing position and operates the pen pressing mechanism 74 to press down the auxiliary shaft members 725 with the plate spring 746.

This operation carries the pen 71 dawn to allow the pen tip portion 713 of the pen 71 to be pressed against the surface of a nail T.

At this time, the pen tip portion 713 is biased downward at a proper pressure by the plate spring 746, enabling the pen 71 to freely move up and down along the surface shape of the nail T for drawing.

If the pens 71 are for drawing with photocurable fluid material, such as photocurable gel ink, the drawing controller 815 operates the Y-direction movement motor 48 to move the drawing head 70 (pen carriage 72) to the farthest place in the Y direction after the pens 71 perform the drawing on the surface of the nail T.

The drawing controller 815 then operates the X-direction movement motor 46 to move the drawing head 70 (pen carriage 72) to the farthest place in the X direction, and again operates the Y-direction movement motor 48 to move the drawing head 70 (pen carriage 72) to the near side in the Y direction.

In this way, the drawing head 70 (pen carriage 72) passes the back of the light-blocking wall 65 and comes to the escape position, where the light-blocking wall 65 is between the drawing head 70 (pen carriage 72) and the UV light sources 911 of the light irradiation mechanism 91.

After moving the drawing head 70 (pen carriage 72) holding the pens 71 to the escape position, the drawing controller 815 turns on the UV light sources 911 of the light irradiation mechanism 91.

In this way the photocurable gel ink or the like applied to the nail T cures, and a glossy gel nail is completed.

In the case of a design with some layers of colors overlaid on one another, the above-described operation is performed each time a predetermined color of ink is applied.

The time for which the UV light sources 911 are on is preferably determined as appropriate in accordance with the type of UV light sources 911, the type of ink, and the ink application manner (e.g., the thickness of ink layer applied to a nail T) etc.

For performing drawing on the nails T of a plurality of fingers, a finger with the nail T for which drawing has completed is pulled out of the finger receiving section 31 and a finger with a next drawing target nail T is inserted in the finger receiving section 31 as a printing finger U1. The nail images of the nail T are then obtained. These processes are then repeated.

As described above, the drawing apparatus 1 of this embodiment includes a pen carriage 72 to hold at least one pen 71 to perform drawing on the surface of a nail T (drawing target surface) with photocurable fluid material, such as photocurable gel ink, to be cured with light. The drawing apparatus 1 also includes a light irradiation mechanism 91 to emit light including light in a specific wavelength region to cure the photocurable gel ink or the like.

Accordingly, the drawing apparatus 1 alone can both perform drawing on the nail T with the photocurable gel ink or the like and cure the ink applied to the nail T.

This eliminates the need for separately preparing an apparatus to cure the photocurable gel ink or the like. Further, this saves the trouble of having to transfer a printing finger U1 to another apparatus after the drawing, allowing a user to easily enjoy beautiful nail arts with lucidity and gloss using photocurable gel ink or the like.

Further, since there is no need to pull out and insert a printing finger U1 after the drawing, the photocurable fluid material, such as photocurable gel ink, that has been applied to a nail T is prevented from touching other fingers and the apparatus and from coming off or damaging.

If the pens 71 held by the pen carriage 72 are exposed to the light from the light irradiation mechanism 91 when the light irradiation mechanism 91 irradiates the photocurable fluid material, such as photocurable gel ink, to cure it in the drawing apparatus 1, there is a risk that the ink on the pen tip portions 713 may cure. To avoid such a risk, the light irradiation mechanism 91 of this embodiment performs the irradiation after the pen carriage 72 holding the pens 71 has been moved to the escape position, where the light-blocking wall 65 lies between the pen carriage 72 and the UV light sources 911 of the light irradiation mechanism 91. This configuration prevents the pens 71 from being exposed to the light from the light irradiation mechanism 91 in the drawing apparatus 1, preventing the ink on the pen tip portions 713 from curing due to the light from the light irradiation mechanism 91.

Second Embodiment

A drawing apparatus and a control method for drawing with a drawing apparatus of a second embodiment of the present invention will now be described with reference to FIGS. 5A to 6C.

The second embodiment is different from the first embodiment mainly in the position of a light irradiation mechanism, and the following description mainly focuses on the features different from those of the first embodiment.

Figure 5B:
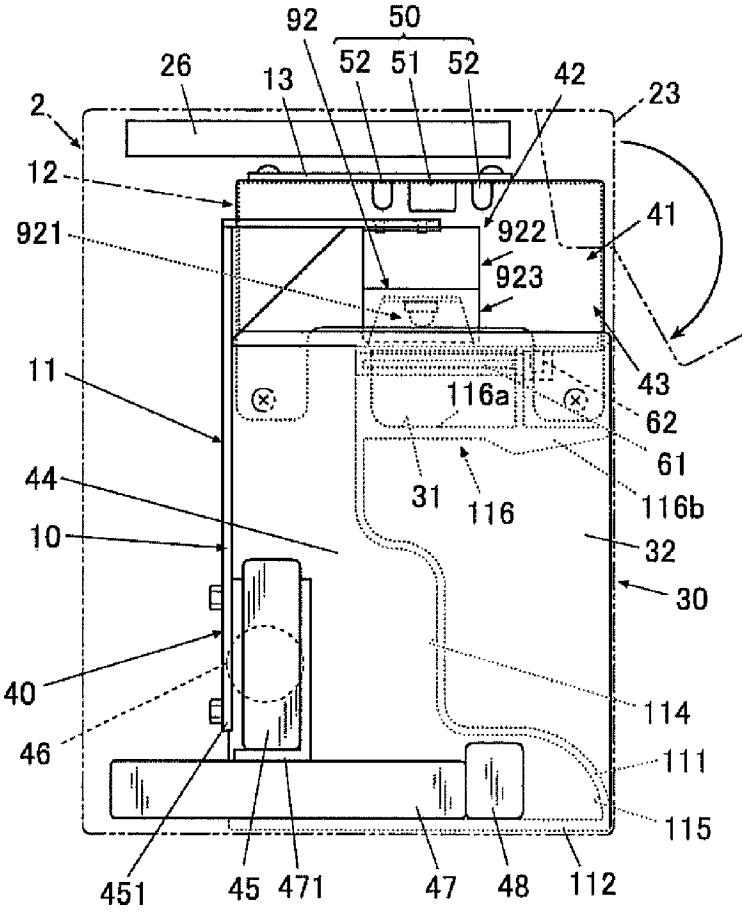
FIG. 5B is a side view showing the internal configuration of the drawing apparatus of FIG. 5A.
Figure 5A:
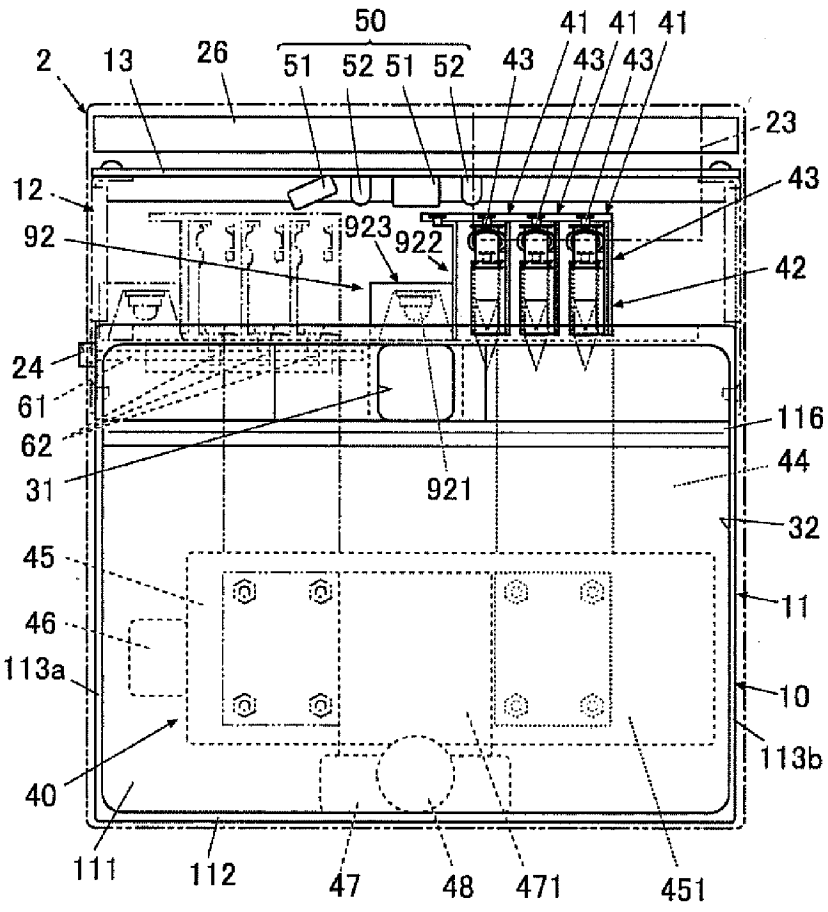
FIG. 5A is a front view of a drawing apparatus in a second embodiment.

FIG. 5A is a front view of a drawing apparatus 1 showing the internal configuration.

FIG. 5B is a side view of the drawing apparatus 1 of FIG. 5A, a part of which is shown in section to describe the internal configuration of the drawing apparatus 1.

As shown in FIGS. 5A and 5B, the drawing apparatus 1 of the second embodiment is a plotter drawing apparatus including a drawing head 42 having pens 41 to perform drawing on nails T of printing fingers U1, as in the first embodiment.

In this embodiment, the drawing head 42 includes three pen carriages 43 each of which holds one of pen 41.

The number of pen carriages 43 and pens 41 provided on the drawing head 42, however, is not limited to this example.

FIG. 5A shows the case in which all of the three pen carriages 43 hold pens 41. It is, however, not necessary that all of the pen carriages 43 hold pens 41 but at least one pen carriage 43 holding a pen 41 is enough.

Figure 6B:
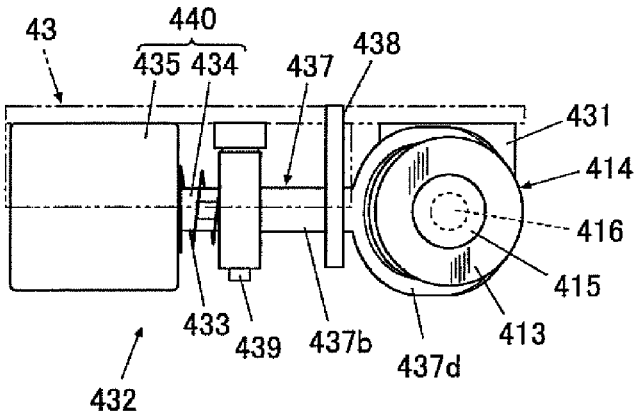
FIG. 6B is a top view of the pen carriage and pen, seen from the direction of arrow b of FIG. 6A.
Figure 6A:
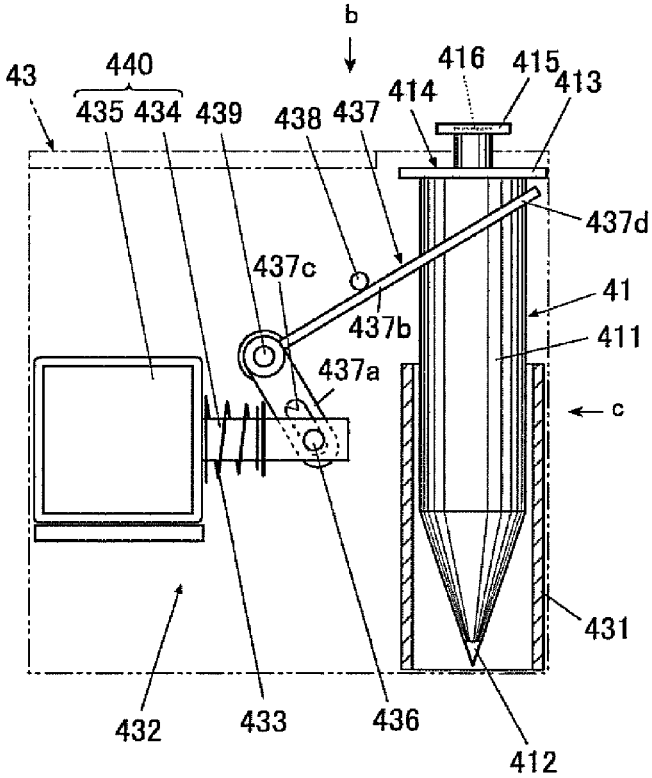
FIG. 6A is a side view of a pen carriage and pen held by the pen carriage.

FIG. 6A is a side view (shown partially in section) of a pen carriage and a pen of this embodiment.

FIG. 6B is a top view of the pen carriage and pen, seen from the direction of arrow b of FIG. 6A.

Figure 6C:
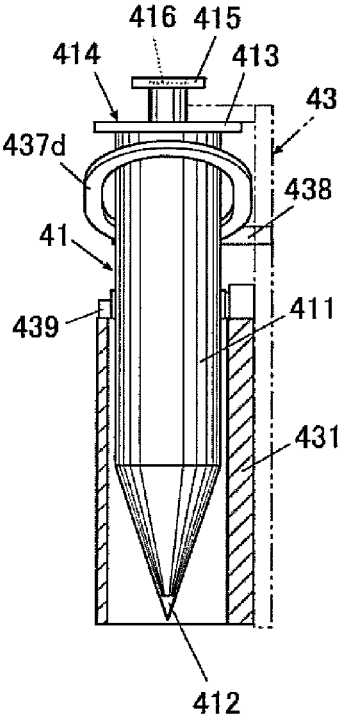
FIG. 6C is a front view of the pen carriage and pen, seen from the direction of arrow c of FIG. 6A.

FIG. 6*c* is a front view (shown partially in section) of the pen carriage and pen, seen from the direction of arrow c of FIG. 6A.

As shown in FIGS. 6A to 6C, the pen 41 held by the pen carriage 43 has a pen shaft 411 and a pen tip portion 412 disposed at an end of the pen shaft 411.

The interior of the pen shaft 411 serves as an ink container to contain various types of inks.

The pen shaft 411 of at least one of the pens 41 contains photocurable fluid material, such as UV curable gel ink, as in the first embodiment.

A lid 414 is attached to the other end of the pen shaft 411. The lid 414 is provided with a flange 413 protruding outward from the pen shaft 411.

The pen shaft 411 and the lid 414 may be made of any material, but resin is preferably used because it is suitable for mass production of the pen 41.

In this embodiment, the lid 414 is provided with a tab 415 at its upper part to be pinched with fingers or tweezers easily. A small piece of iron 416 is embedded in or adheres to the tab 415 to be attached to a magnet.

The pen 41 is held by a pen supporting part 437*d* and a pen holder 431 of the pen carriage 43, with the pen 41 just inserted into the pen supporting part 437*d* and the pen holder 431 from above, as described later. The pen 41 thus can be easily taken out from the supporting part 437*d* and the pen holder 431 to be replaced by opening the cover 23 for pen replacement of the case body 2 and pinching the tab 415 with fingers or tweezers or bringing a stick (not shown) with a magnet at its tip portion close to the tab 415 for the magnet to attract the iron piece 416 to pull the pen 41 up.

The carriage 43 includes the pen holder 431 to hold a pen 41 substantially vertically, and a pen up-and-down mechanism 432 to carry the pen 41 up and down.

The pen holder 431 is a cylindrical portion into which the pen tip portion 412 and the pen shaft 411 are inserted to hold the pen 41.

The pen up-and-down mechanism 432 includes a solenoid 440 including a plunger 434 and a coil 435, a pin 436 attached to the moving end part of the plunger 434 of the solenoid 440, a pen up-and-down lever 437 connected to the plunger 434 through the pin 436, and a stopper 438 to prevent the pen up-and-down lever 43'7 from moving up to a position exceeding the upper limit.

The plunger 434 is biased forward by a spring 433 (i.e., rightward in FIG. 6A), and the solenoid 440 is a pull solenoid to pull the plunger 434 rearward (i.e., leftward in FIG. 6A) against the biasing force of the spring 433.

The solenoid 440 may be a push solenoid instead of the pull solenoid.

As shown in FIG. 6A, the pen up-and-down lever 437 is an L-shaped member having a short arm 437*a* and a long arm 437*b* substantially perpendicular to each other. The short arm 437*a* has a long hole 437*c* at its end part. The long hole 437*c* is engaged with the pin 743.

The long arm 437*b* has a pen supporting part 437*d* at its end part into which a pen 41 is to be inserted.

The pen supporting part 437*d* is in the shape of a ring having an inner diameter larger than those of the pen shaft 411 and pen tip portion 412 of the pen 41, and smaller than that of the flange 413 of the pen 41. The pen shaft 411 and pen tip portion 412 are inserted into the pen supporting part 437*d*, and the pen supporting part 437*d* catches the flange 413 so as to support the flange 413 from below.

A rotation shaft 439 is inserted in the intersection of the short arm 437*a* and the long arm 437*b* of the pen up-and-down lever 437, the rotation shaft 439 being fixed at the pen carriage 43 side.

In this embodiment, when the solenoid 440 is being driven, the plunger 434 is pulled rearward against the biasing force of the spring 433.

In this state, the tip portion 412 of the pen 41 is below the pen holder 431 of the pen carriage 43 and can touch the surface of a nail T or a drawing medium, which is a drawing state.

When the solenoid 440 is off, the biasing force of the spring 433 pushes the plunger 434 forward.

In this way, the pen up-and-down lever 437 brings the flange 413 of the pen 41 upward (see FIG. 6A).

In this state, the tip portion 412 of the pen 41 is above the lower end of the pen holder 431 of the pen carriage 43 and is disposed completely inside of the pen holder 431. At this time, the pen tip portion 412 does not touch the surface of a nail T or a drawing medium, which is a non-drawing state.

The pen 41 is just inserted in the pen holder 431 of the pen carriage 43 but is not fixed to the pen up-and-down lever 437 etc. This allows the pen 41 to be biased downward for its own weight.

The pen 41 thus can freely go up and down the pen holder 431 for the flange 413 to come into contact with the upper surface of the pen supporting part 437*d*, and when the pen tip portion 412 touches the surface of a nail T or a drawing medium, the pen tip portion 412 presses the surface of the nail T or the drawing medium.

In other words, when the pen 41 makes a drawing on a nail T, the pen tip portion 412 can freely move in the Z direction (i.e., vertical direction) perpendicular to the X-Y plane, on which a printing finger U1 is placed, along the shape (ups and downs) of the surface of the nail T in accordance with the curve and height of the nail T.

In this embodiment, pen caps 62 made of rubber, for example, are disposed in front of the pen warm-up section 61 (i.e., at the near side in the finger insertion direction).

When the pens 41 held by the pen holders 431 of the drawing head 42 are not performing drawing (i.e., the non-drawing time), the pens 41 are carried down and the pen tip portions 412 are fitted in the pen caps 62 to prevent the pen tip portions 412 from drying.

The area of the pen caps 62 is the home space where the pens 41 stand by at the non-drawing time.

In this embodiment, the pen caps 62 are disposed beside the pen warm-up section 61 as described above. In starting the drawing, the pens 41 are lifted and perform warm-up drawing on the close-by pen warm-up section 61, and then, regular drawing starts.

This minimizes the time required for the movement of the pens 41 and enables quick drawing.

In this embodiment, a light irradiation mechanism 92 is attached to the drawing head 42. The light irradiation mechanism 92 emits light including light in a specific wavelength region to cure the photocurable fluid material applied to a nail T with the pens 41, similarly to the light irradiation mechanism 91.

The head drive section 49 (i.e., the X-direction movement motor 46 and the Y-direction movement motor 48) to move the drawing head 42 also moves the light irradiation mechanism 92 together with the drawing head 42 as one body in the lateral direction (i.e., the lateral direction in FIG. 5A or X direction) and the front-back direction (i.e., the right-left direction in FIG. 5B or Y direction) of the drawing apparatus 1.

A light-blocking wall 922 is disposed between the light irradiation mechanism 92 and the pen carriages 43 holding the pens 41. The light irradiation mechanism 92 is fixed to the light-blocking wall 922.

The lower end of the light-blocking wall 922 is below the level of the lower ends of the pen carriages 43. Accordingly, the light from the light irradiation mechanism 92, which is separated by the light-blocking wall 922 from the pen carriages 43 holding the pens 41, is prevented from coming to the pen carriages 43 from below the light-blocking wall 922.

The light irradiation mechanism 92 includes a UV light source (light source unit) 921 to emit ultraviolet rays and a light-blocking cover 923 surrounding the UV light source 921.

In this embodiment, the light-blocking wall 922 and the light-blocking cover 923 constitute a light-blocking member.

The light-blocking cover 923 has a size and position such that the lower end of the light-blocking cover 923 comes close to the upper surface of the finger receiving section 31 when the light-blocking cover 923 is above the finger receiving section 31. The light-blocking cover 923 preferably has a size and shape to cover the exposing window 31*e* of the finger receiving section 31 when the light-blocking cover 923 is above the finger receiving section 31.

The light-blocking cover 923 preferably has a reflection part (not shown) inside of the light-blocking cover 923 to prevent the diffusion of light from the UV light source 921 and to concentrate the light on the nail T of a printing finger U1 inserted in the finger receiving section 31. The reflection part is formed by applying mirror finishing or plating to the inner side of the light-blocking cover 923, for example.

Since the other configurations are the same as those of the first embodiment, the same components are indicated by the same reference numbers/alphabets, and the explanations for such components are omitted.

The operation of the drawing apparatus and the control method for drawing in this embodiment will now be described.

When the drawing data for a nail design has been generated and warm-up drawing has been completed, the drawing controller 815 outputs control signals to the drawing unit 7 based on the drawing data and controls the drawing head 42 to perform drawing based on the drawing data.

Specifically, the drawing controller 815 operates the head drive section 49 to move the drawing head 42 to a position above a nail T (drawing target surface). When a pen 41 comes to a predetermined position, the drawing controller 815 operates the solenoid 440 to carry the pen 41 up and down so that the pen tip portion 412 touches the surface of the nail T and performs drawing based on the drawing data.

In the case in which the pens 41 contain photocurable fluid material for drawing, such as photocurable gel ink, the drawing controller 815 operates the solenoid 440 so that the pen tip portion 412 is lifted and encased in the pen holder 431 after the drawing controller 815 performs drawing on the nail T with the pen 41.

The drawing controller 815 then operates the head drive section 49 to move the light irradiation mechanism 92 to a position above the finger receiving section 31. The drawing controller 815 then turns on the UV light source 921 of the light irradiation mechanism 92. The photocurable gel ink or the like that has been applied to the nail T is thereby cured and a glossy gel nail is finished.

The light from the UV light source 921 is blocked by the light-blocking wall 922 and the light-blocking cover 923 and is prevented arriving at the pen tip portions 412 of the pens 41 held by the pen carriages 43.

When the UV light source 921 is on, the light irradiation mechanism 92 is preferably moved in the Y direction by the Y-direction movement stage 47 or in the X and Y directions by the X-direction movement stage 45 and the Y-direction movement stage 47, so that the entire surface of the nail T is irradiated with the light from the UV light source 921.

Since the other operations are the same as those in the first embodiment, the explanations for them are omitted.

As described above, the second embodiment can bring about the following advantageous effects as well as the same advantageous effects as those of the first embodiment.

The light irradiation mechanism 92 is attached to the drawing head 42 in the second embodiment, and the light irradiation mechanism 92 can be moved together with the drawing head 42 as one body by the head drive section 49 (i.e., the X-direction movement motor 46 and the Y-direction movement motor 48) in the lateral direction (i.e., the lateral direction in FIG. 5A or X direction) and the front-back direction (i.e., the right-left direction in FIG. 5B or Y direction) of the drawing apparatus 1.

Such a configuration creates a larger space in the drawing apparatus than in the case in which the light irradiation mechanism 92 is disposed on the ceiling of the apparatus, and allows the light irradiation mechanism 92 to be positioned so as not to affect the movement of the drawing head 42.

Further, the UV light source 921 can come closer to the surface of the nail T (drawing target surface) in the second embodiment than in the first embodiment. So, if a light source having the same emission intensity as that of the first embodiment is used in the second embodiment, the surface of the nail T can be irradiated with a stronger light, leading to reduction in time required to cure the photocurable gel ink or the like applied to the nail T.

If the time for the curing operation in the second embodiment is set to about the same time as in the first embodiment, the second embodiment can use a light source with lower intensity than that for the first embodiment, leading to reduction in power consumption.

Further, the light-blocking cover 923 and the finger receiving section 31 in the second embodiment are close to each other, leading to reduction in leak of light to the environment and enabling irradiation of a nail T with condensed light.

This can reduce time required to cure the photocurable gel ink or the like applied to the nail T.

Attaching the light irradiation mechanism 92 to the drawing head 42 reduces the distance between the UV light source 921 to emit light and the pens 41. Nevertheless, in the second embodiment, the light from the UV light source 921 can be prevented arriving at the pen tip portions 412 of the pens 41 held by the pen carriages 43 because the light irradiation mechanism 92 is separated from the pen carriages 43 by the light-blocking wall 922 and because the light-blocking cover 923 is disposed around the UV light source 921.

In the second embodiment, the pen carriages 43 holding the pens 41 are disposed on the side opposite to the side where the pen caps 62 are disposed when the light irradiation mechanism 92 is above the finger receiving section 31. The layout of the pen carriages 43 and the pen caps 62, however, is not limited to the example shown in the drawings.

For example, the pen caps 62 may be disposed on the right side of FIG. 5A, and the pen tip portions 412 of the pens 41 may be disposed above the pen caps 62 when the light irradiation mechanism 92 is above the finger receiving section 31.

In this case, the pen tip portions 412 can be put in the pen caps 62 during the irradiation by the light irradiation mechanism 92. This reliably prevents the light from traveling around to arrive at the pen tip portions 412.

Third Embodiment

A drawing apparatus of a third embodiment of the present invention will now be described with reference to FIGS. 7A to 8B.

The third embodiment is different from the first and second embodiments mainly in the position of a light irradiation mechanism, and the following description mainly focuses on the features different from those of the first and second embodiments.

Figure 7B:
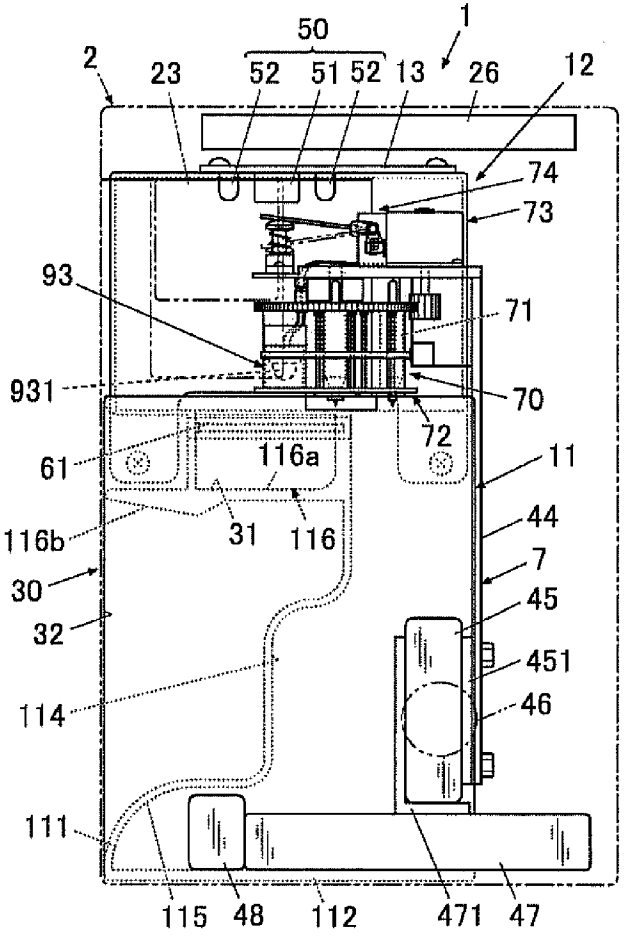
FIG. 7B is a side view showing the internal configuration of the drawing apparatus of FIG. 7A.
Figure 7A:
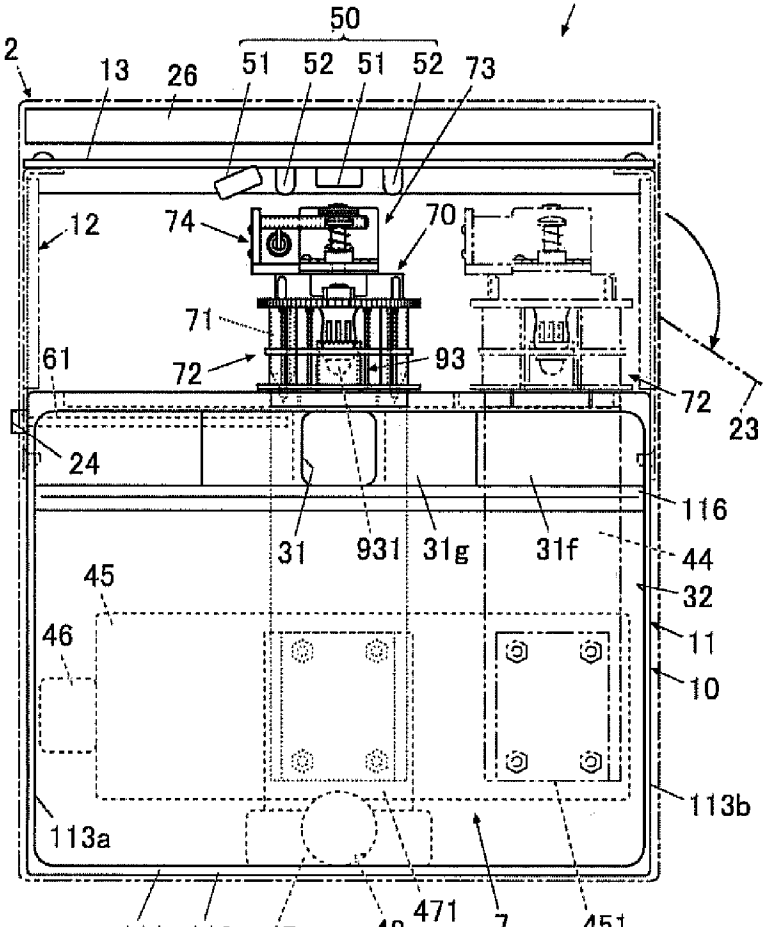
FIG. 7A is a front view of a drawing apparatus in a third embodiment.

FIG. 7A is a front view of a drawing apparatus 1 showing the internal configuration.

FIG. 7B is a side view of the drawing apparatus 1 of FIG. 7A, a part of which is shown in section to describe the internal configuration of the drawing apparatus 1.

As shown in FIGS. 7A and 7B, the drawing apparatus 1 of the third embodiment is a plotter drawing apparatus including a drawing head 70 having a rotary pen carriage 72 holding pens 71 to perform drawing on nails T of printing fingers U1, as in the first embodiment.

As shown in FIGS. 7A and 7B, the drawing head 70 in this embodiment holds a light irradiation mechanism 93 on a part of the rotary pen carriage 72.

Figure 8A:
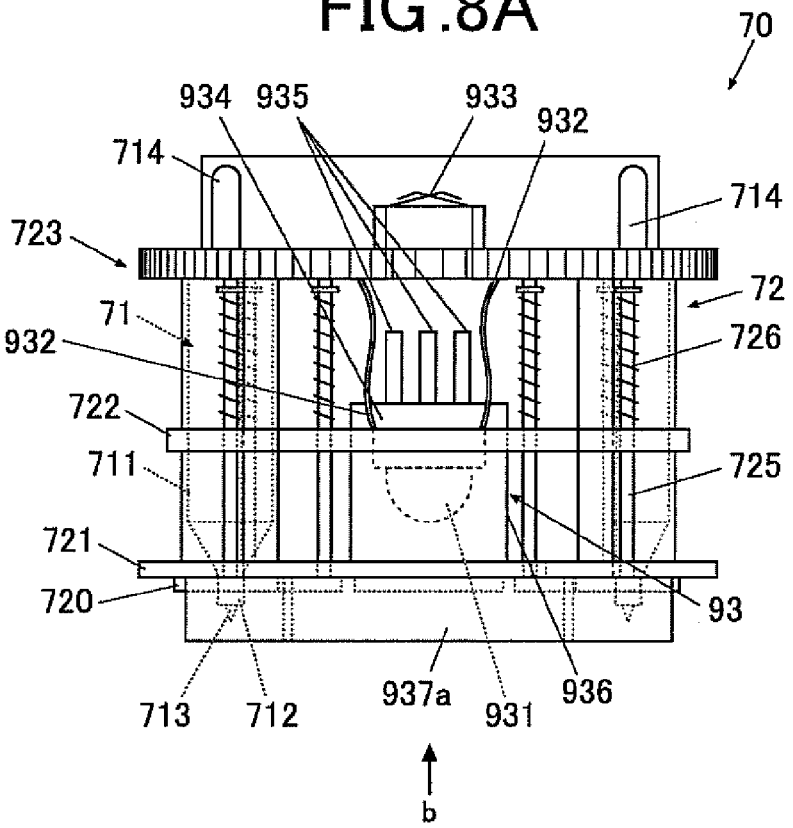
FIG. 8A is a side view of a pen carriage and pens and a light irradiation mechanism held by the pen carriage.

FIG. 8A is an enlarged view of the drawing head 70 in this embodiment.

Figure 8B:
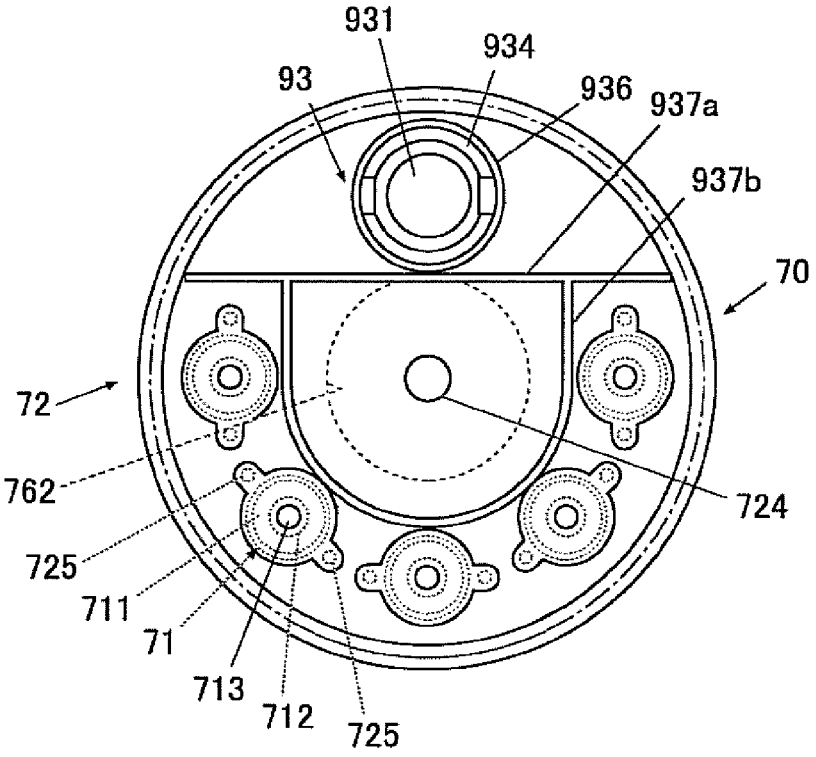
FIG. 8B is a bottom view of the pen carriage, pens, and light irradiation mechanism, seen from the direction of arrow b of FIG. 8A.

FIG. 8B is a bottom view of the drawing head 70, seen from the direction of arrow b of FIG. 8A.

In this embodiment, a light irradiation mechanism 93 includes a UV light source (light source unit) 931 and a light-blocking cover 936 disposed on one end part of the pen carriage 72 as shown in FIGS. 7A and 7B. The light-blocking cover 936 attached to the one end part of the pen carriage 72 contains the UV light source 931 therein and opens downward.

A mirror finishing or vapor-deposited reflection coating is applied to the inner side of the light-blocking cover 936 so that the light from the UV light source 931 is focused on the nail T of a printing finger U1 inserted in the finger receiving section 31.

The UV light source 931 in this embodiment is connected to a spring contact part 933 (e.g., a contact part constituted of a contact brush etc.) through a conducting wire 932.

When the pen carriage 72 rotates and the light irradiation mechanism 93 comes to a predetermined position above the finger receiving section 31 (e.g., when the light irradiation mechanism 93 is at nearest side of the apparatus as shown in FIGS. 7A and 7B), the spring contact part 933 is connected to a substrate-side contact (not shown) and thereby the UV light source 931 is turned on under the control of the control unit.

As shown in FIG. BA, a radiator substrate 934 and radiator fins 935 are provided over the UV light source. 931 in this embodiment. When the UV light source 931 is turned on and generates heat, the radiator substrate 934 and radiator fins 935 radiate the heat outside and prevent an irradiated nail T and the finger from getting too hot.

Providing the radiator substrate 934 and the radiator fins 935 is not essential. Also the radiator substrate 934 and the radiator fins 935 may have any layout and shapes other than the example shown in the drawing.

As shown in FIG. 8B, light-blocking walls 937*a* and 937*b* are provided at the bottom of the pen carriage 72 between the light-blocking cover 936 of the light irradiation mechanism 93 and the pen tip portions 713 of the pens 71 held by the pen carriage 72.

The light-blocking walls 937*a* and 937*b* protrude downward to a level lower than the bottom end of the light-blocking cover 936 so as to prevent the light from the UV light source 931 of the light irradiation mechanism 93 from coming around to the pen tip portions 713. The shapes etc. of the light-blocking walls 937*a* and 937*b* are not limited to the example shown in the drawings.

In this embodiment, the light-blocking cover 936 and the light-blocking walls 937*a* and 937*b* constitute the light-blocking member.

Since the other configurations are the same as those of the first and second embodiments, the same components are indicated by the same reference numbers/alphabets, and the explanations for such components are omitted.

The operation of the drawing apparatus and the control method for drawing in this embodiment will now be described.

When the drawing data for a nail design has been generated and warm-up drawing has been completed, the drawing controller 815 outputs control signals to the drawing unit 7 based on the drawing data and controls the drawing head 70 to perform drawing based on the drawing data.

Specifically, the drawing controller 815 operates the head drive section 49 to move the drawing head 70 to a position above a nail T (drawing target surface). When a pen 71 comes to a predetermined position, the drawing controller 815 operates the solenoid 740 of the pen pressing mechanism 74 so that the pen tip portion 713 touches the surface of the nail T and performs drawing based on the drawing data.

In the case in which the pens 71 contain photocurable fluid material for drawing, such as photocurable gel ink, the drawing controller 815 operates the solenoid 740 so that the pen tip portion 713 is lifted and encased in the pen cylindrical member 761 (which serves as a pen holder) of the pen carriage 72 after the drawing controller 815 performs drawing on the surface of the nail T with the pen 71.

The drawing controller 815 then operates the step motor 731 of the carriage rotating mechanism 73 to move the light irradiation mechanism 93 to a position above the finger receiving section 31.

This allows the spring contact part 933 of the light irradiation mechanism 93 to be connected to the substrate-side contact, and the signal from the control unit allows the UV light source 931 to be turned on. The photocurable gel ink or the like that has been applied to the nail T is thereby cured and a glossy gel nail is finished.

The light from the UV light source 931 is blocked by the light-blocking cover 936 and the light-blocking walls 937*a* and 937*b* and is prevented arriving at the pen tip portions 713 of the pens 71 held by the pen carriage 72.

When the UV light source 931 is on, the light irradiation mechanism 93 is preferably moved in the Y direction by the Y-direction movement stage 47 or in the X and Y directions by the X-direction movement stage 45 and the Y-direction movement stage 47, so that the entire surface of the nail T is irradiated with the light from the UV light source 931.

Since the other operations are the same as those in the first embodiment etc., the explanations for them are omitted.

As described above, the third embodiment can bring about the following advantageous effects as well as the same advantageous effects as those of the first embodiment etc.

The light irradiation mechanism 93 is attached to the drawing head 70 in the third embodiment, and the light irradiation mechanism 93 can be moved together with the drawing head 70 as one body by the head drive section 49 (i.e., the X-direction movement motor 46 and the Y-direction movement motor 48) in the lateral direction (i.e., the lateral direction in FIG. 7A or X direction) and the front-back direction (i.e., the right-left direction in FIG. 7B or Y direction) of the drawing apparatus 1.

Such a configuration creates a larger space in the drawing apparatus than in the case in which the light irradiation mechanism 93 is disposed on the ceiling of the apparatus, and allows the light irradiation mechanism 93 to be positioned so as not to affect the movement of the drawing head 70.

Further, the UV light source 931 can come close to the surface of the nail T (drawing target surface) in the third embodiment, similarly to the second embodiment. Further, the light-blocking cover 936 can come close to the finger receiving section 31 in the third embodiment. Such a configuration reduces leak of light to the environment and enables irradiation of a nail T with condensed light, leading to reduction in time required to cure the photocurable gel ink or the like applied to the nail T.

Attaching the light irradiation mechanism 93 to the drawing head 70 reduces the distance between the UV light source 931 to emit light and the pens 71. Nevertheless, in the third embodiment, the light from the UV light source 931 can be prevented from arriving at the pen tip portions 713 of the pens 71 because the light irradiation mechanism 93 is separated from the pens 71 by the light-blocking walls 937*a* and 937*b* and because the light-blocking cover 936 is disposed around the UV light source 931.

Fourth Embodiment

A drawing apparatus of a fourth embodiment of the present invention will now be described with reference to FIGS. 9A to 12B.

The fourth embodiment is different from the first to third embodiments mainly in the position and configuration of a light irradiation mechanism, and the following description mainly focuses on the features different from those of the first to third embodiments.

Figure 9B:
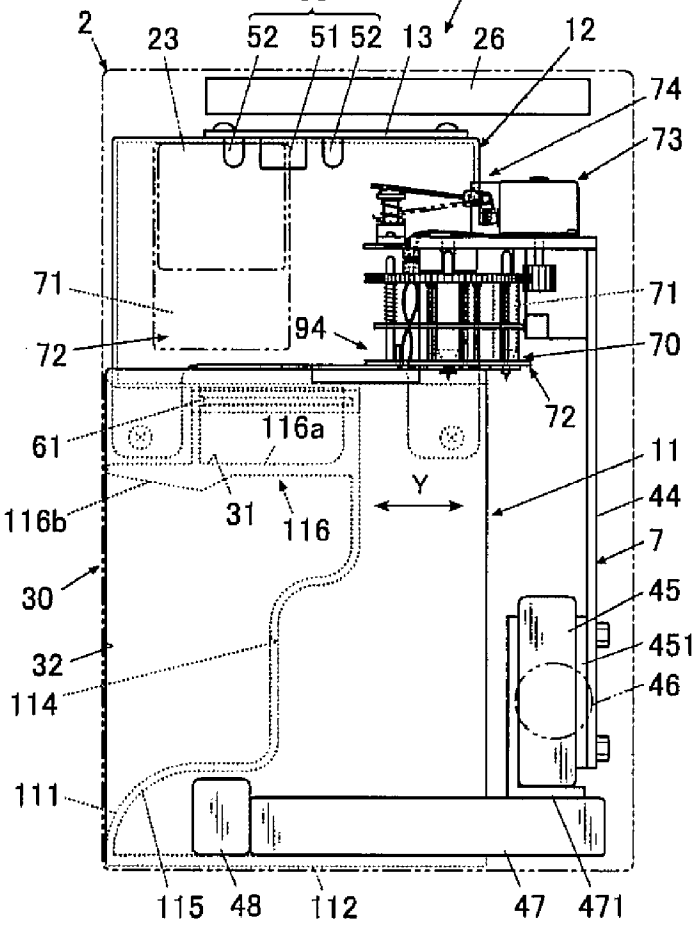
FIG. 9B is a side view showing the internal configuration of the drawing apparatus of FIG. 9A.
Figure 9A:
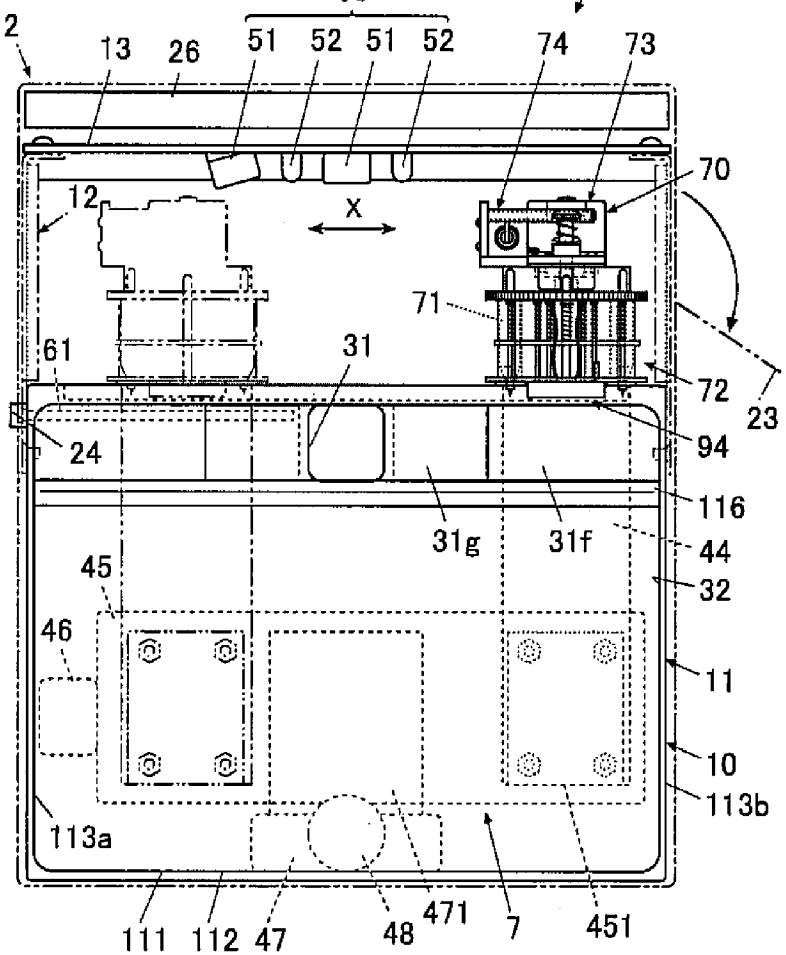
FIG. 9A is a front view of a drawing apparatus in a fourth embodiment.

FIG. 9A is a front view of a drawing apparatus 1 showing the internal configuration.

FIG. 9B is a side view of the drawing apparatus 1 of FIG. 9A, a part of which is shown in section to describe the internal configuration of the drawing apparatus 1.

As shown in FIGS. 9A and 9B, the drawing apparatus 1 of the fourth embodiment is a plotter drawing apparatus including a drawing head 70 having a rotary pen carriage 72 holding pens 71 to perform drawing on nails T of printing fingers U1, as in the first embodiment.

Figure 10A:
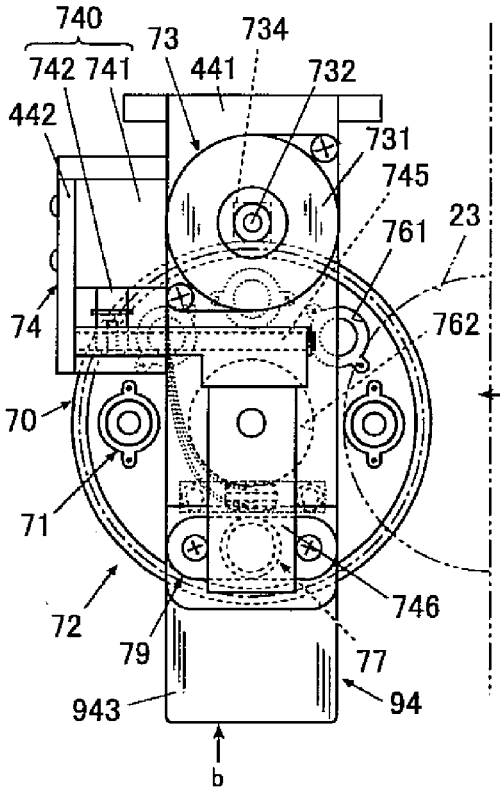
FIG. 10A is a top view of a drawing head in the fourth embodiment.

FIG. 10A is a top view of the drawing head 70 in the fourth embodiment.

Figure 10C:
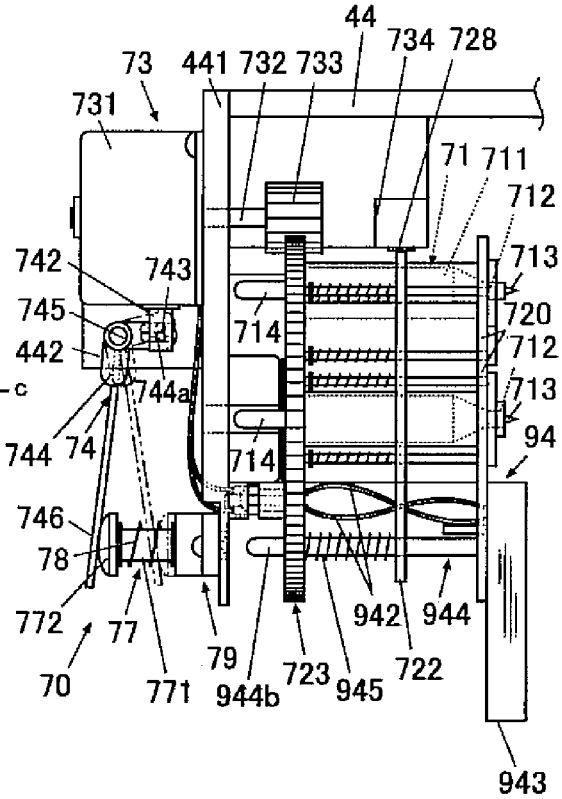
FIG. 10C is a side view of the drawing head, seen from the direction of arrow c of FIG. 10A.
Figure 10B:
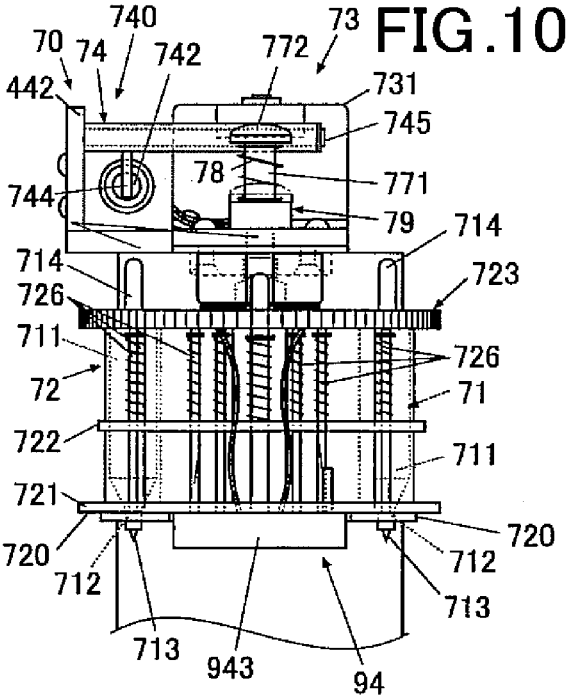
FIG. 10B is a front view of the drawing head, seen from the direction of arrow b of FIG. 10A.

FIG. 10B is a front view of the drawing head 70, seen from the direction of arrow b of FIG. 10A.

FIG. 10C is a side view of the drawing head 70, seen from the direction of arrow c of FIG. 10A.

As shown in FIGS. 10A to 10C, the drawing head 70 in this embodiment holds a light irradiation mechanism 94 on a part of the rotary pen carriage 72.

Figure 11B:
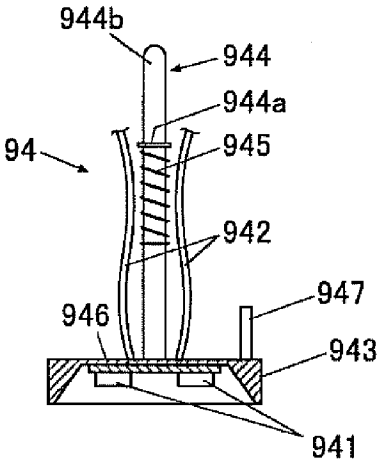
FIG. 11B is a sectional view of the light irradiation mechanism of FIG. 11A, a part of which is shown in section to describe the internal configuration.
Figure 11C:
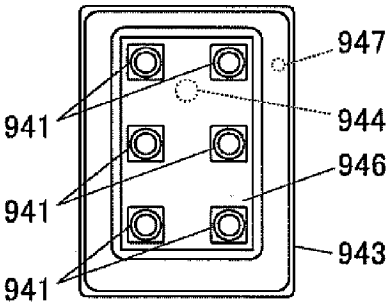
FIG. 11C is a bottom view of the light irradiation mechanism shown in FIG. 11B.
Figure 11A:
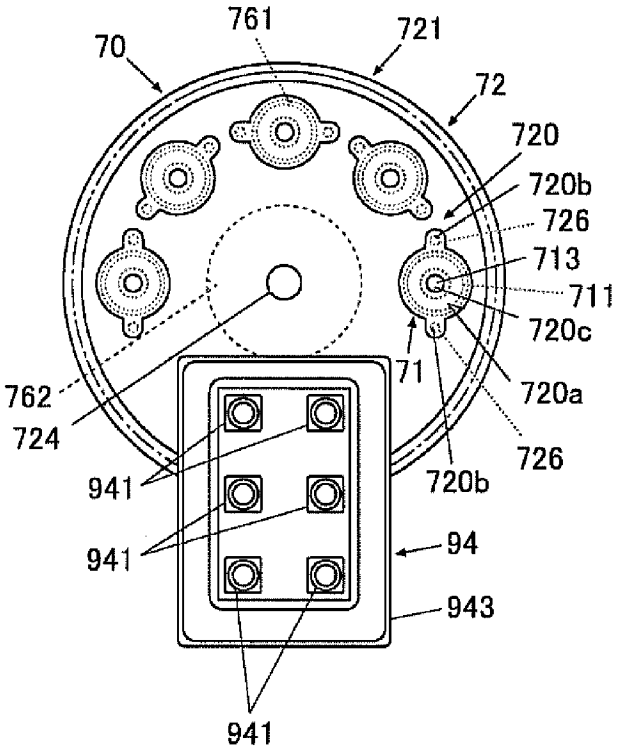
FIG. 11A is a bottom view of a pen carriage and pens and a light irradiation mechanism held by the pen carriage in the fourth embodiment.

FIG. 11A is a bottom view of the drawing head 70.

FIG. 11B is a sectional view of the light irradiation mechanism 94 of this embodiment, a part of which is shown in section to describe the internal configuration.

FIG. 11C is a bottom view of the light irradiation mechanism 94 shown in FIG. 11B.

Figure 12A:
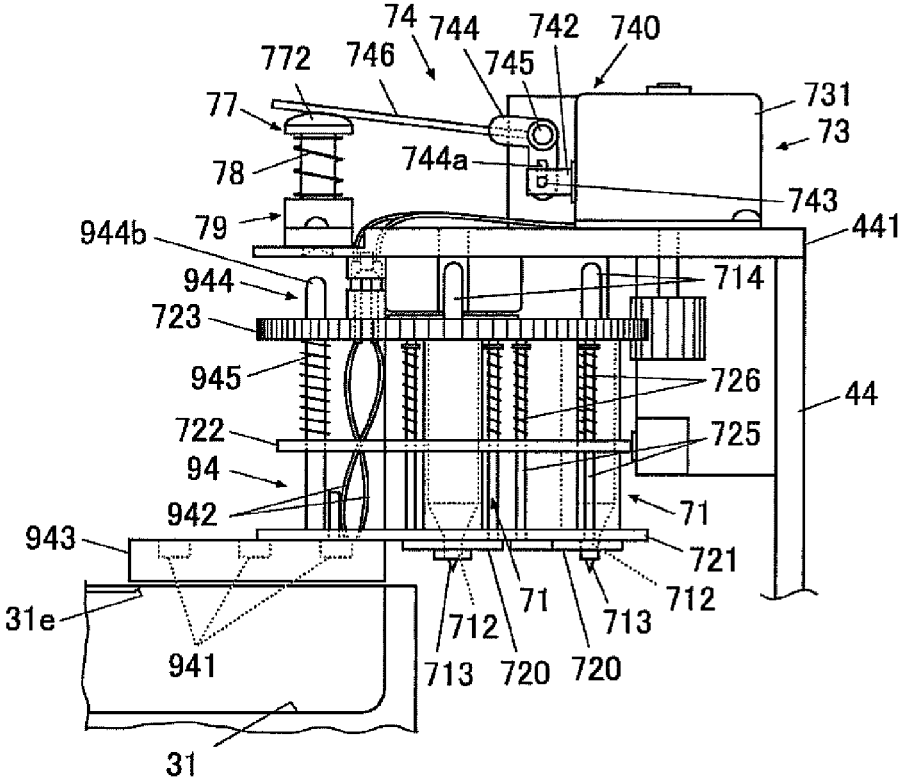
FIG. 12A is a side view of the light irradiation mechanism before being pressed in the forth embodiment.

FIG. 12A is a side view of the light irradiation mechanism 94 of this embodiment that is not pressed and is at a non-irradiation position.

Figure 12B:
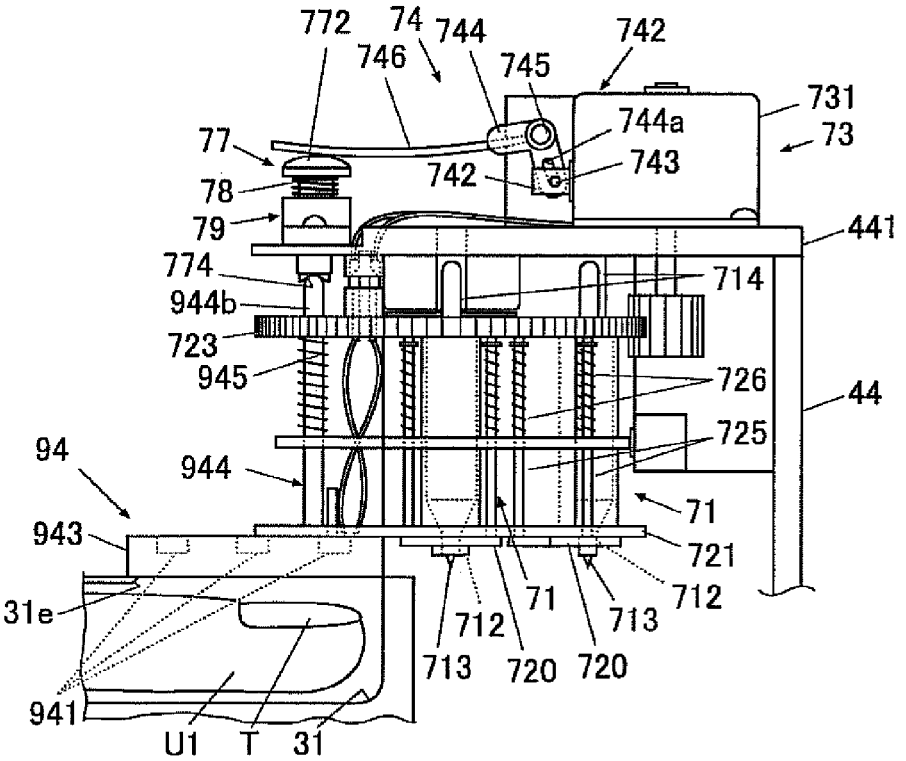
FIG. 12B is a side view of the light irradiation mechanism of FIG. 12A being pressed.

FIG. 12B is a side view of the light irradiation mechanism 94 of this embodiment that is pressed and is at an irradiation position.

As shown in FIGS. 11A and 113, the light irradiation mechanism 94 of this embodiment includes a light-blocking cover 943 and a plurality of UV light sources (light source unit) 941. The light-blocking cover 943 is movable in the height direction and has an opening at its bottom. The light-blocking cover 943 contains the UV light sources 941 therein.

The light-blocking cover 943 has a mirror finishing or vapor-deposited reflection coating applied to the inner side of the light-blocking cover 943. The light-blocking cover 943 has a shape and configuration such that the opening can completely cover the entire exposing window 31*e* in the upper surface of the finger receiving section 31, and that the entire surface of the nail T can be irradiated with the light from the plurality of UV light sources 941.

Such a configuration enables exposure of the entire surface of the nail T to the light from the UV light sources 941 of the light irradiation mechanism 94 without the need to move the light irradiation mechanism 94. Further, such a configuration hardly lets out the light from the UV light sources 941.

Specifically, the area to be irradiated by the light irradiation mechanism 94 of the fourth embodiment is larger than that of the second and third embodiments and is larger than the area of the entire surface of a nail T. The light-blocking cover 943 of the light irradiation mechanism 94 serves a light-blocking member to block light from the UV light sources 941 and also serves as a radiator to radiate heat generated by the UV light sources 941.

In this embodiment, six UV light sources 941 are disposed in the light-blocking cover 943.

The UV light sources 941 are connected to a substrate (not shown) through conducting wires 942 and are controlled to be on and off.

The number and layout of the UV light sources 941 are not limited to the example shown in the drawings.

A radiator plate 946 is provided on the UV light sources 941 to radiate the heat generated from the UV light sources 941.

The radiator plate 946, however, is not an essential element but can be omitted.

In this embodiment, a support member 944 is disposed upright on the upper surface of the light-blocking cover 943 at one end part of the light-blocking cover 943.

The support member 944 is provided with an E-ring 944*a* protruding outward near the upper end of the support member 944.

The support member 944 passes through the through-hole in each of the first plate member 721, the second plate member 722, and the third plate member 723 in such a way that the shaft tip 944*b* projects upward from the third plate member 723.

A coil spring 945 is provided around the support member 944 and between the E-ring 944*a* and the second plate member 722.

An anti-rotation pin 947 to be engaged with the pen carriage 72 is provided on the upper surface of the light-blocking cover 943.

The anti-rotation pin 947 engaged with the pen carriage 72 prevents the light irradiation mechanism 94 from rotating around the support member 944.

In this embodiment, a finger or toe is inserted in the finger receiving section 31 having an exposing window 31*e* to expose the surface of the nail T (drawing target surface).

In this embodiment, the apparatus includes a height movement mechanism to move the light-blocking cover 943 of the light irradiation mechanism 94 in the height direction.

The movement mechanism allows the light irradiation mechanism 94 to be at an irradiation position, where the lower surface of the light-blocking cover 943 is in contact with the upper surface of the finger receiving section 31 in such a way that the opening of the light-blocking cover 943 covers the whole exposing window 31*e*; and at a non-irradiation position, where the lower surface of the light-blocking cover 943 is separated from the upper surface of the finger receiving section 31.

In this embodiment, the pen pressing mechanism 74, which presses down a pen 71, also serves as a height movement mechanism to move the light-blocking cover 943 of the light irradiation mechanism 94 in the height direction.

Specifically, the shaft tip 944*b* of the support member 944 is pressed down by a pressing part 774 at the lower end of the sliding pin 77 when the light irradiation mechanism 94 is disposed under the sliding pin 77 of the pen pressing mechanism 74 and when the sliding pin 77 is pressed and moved down by the pen pressing mechanism 74.

When the shaft tip 944*b* is pressed down by the pressing part 774, the light-blocking cover 943 of the light irradiation mechanism 94 is pressed down and the coil spring 945 is compressed between the second plate member 722 and the E-ring 944*a*.

On the other hand, when the pressing part 774 stops applying the pressure, the reactive force of the coil spring 945 presses the light-blocking cover 943 of the light irradiation mechanism 94 upward back to the original position.

The configuration to move the light irradiation mechanism 94 up and down is not limited to the example shown here.

Since the other configurations are the same as those of the first embodiment etc., the same components are indicated by the same reference numbers/alphabets, and the explanations for such components are omitted.

The operation of the drawing apparatus and the control method for drawing in this embodiment will now be described with reference to FIGS. 12A and 12B.

When the drawing data for a nail design has been generated and warm-up drawing has been completed, the drawing controller 815 outputs control signals to the drawing unit 7 based on the drawing data and controls the drawing head 70 to perform drawing based on the drawing data.

Specifically, the drawing controller 815 operates the head drive section 49 to move the drawing head 70 to a position above a nail T (drawing target surface). When a pen 71 comes to a predetermined position, the drawing controller 815 operates the solenoid 740 of the pen pressing mechanism 74 so that the pen tip portion 713 touches the surface of the nail T and performs drawing based on the drawing data.

In the case in which the pens 71 contain photocurable fluid material for drawing, such as photocurable gel ink, the drawing controller 815 operates the solenoid 740 so that the pen tip portion 713 is lifted and encased in the pen cylindrical member 761 (which serves as a pen holder) of the pen carriage 72 after the drawing controller 815 performs drawing on the surface of the nail T with the pen 71.

The drawing controller 815 then operates the step motor 731 of the carriage rotating mechanism 73 to move the light irradiation mechanism 94 to a position above the finger receiving section 31.

In this state, the lower surface of the light-blocking cover 943 of the light irradiation mechanism 94 is separated from the upper surface of the finger receiving section 31 as shown in FIG. 12A.

The drawing controller 815 then operates the solenoid 740 of the pen pressing mechanism 74 to press down the shaft tip 944*b* of the support member 944 of the light irradiation mechanism 94 with the pressing part 774 of the sliding pin 77.

Accordingly, the lower surface of the light-blocking cover 943 of the light irradiation mechanism 94 comes into contact with the upper surface of the finger receiving section 31 in such a way that the opening of the light-blocking cover 943 almost completely coincides with the exposing window 31*e* so as to cover the whole exposing window 31*e* almost completely. The light from the light irradiation mechanism 94 thus hardly leaks out as shown in FIG. 12B.

In this state, the drawing controller 815 turns on the UV light sources 941 of the light irradiation mechanism 94.

The photocurable gel ink or the like that has been applied to the nail T is thereby cured and a glossy gel nail is finished.

When the UV light sources 941 of the light irradiation mechanism 94 are on, the light irradiation mechanism 94 is fixed in such a position that the lower surface of the light-blocking cover 943 is in contact with the upper surface of the finger receiving section 31 and that the opening of the light-blocking cover 943 covers the exposing window 31*e*.

Since the other operations are the same as those in the first embodiment etc., the explanations for them are omitted.

As described above, the fourth embodiment can bring about the following advantageous effects as well as the same advantageous effects as those of the first embodiment etc.

In this embodiment, the light irradiation mechanism 94 is movable in the height direction with a mechanism to move the pens 71 up and down.

This configuration enables the UV light sources 941 to come closer to the surface of the nail T (drawing target surface), enabling reliable, efficient, and focused irradiation to nails T.

Further, the area to be irradiated by the light irradiation mechanism 94 is larger than the entire surface of a nail T. This eliminates the need to move the light irradiation mechanism 94 for curing gel ink or the like as required in the second and third embodiments, leading to further reduction in time required to cure the photocurable gel ink or the like applied to the nail T.

Further, the irradiation is performed while the light-blocking cover 943 as a light-blocking member completely covers the exposing window 31*e* of the finger receiving section 31. Such a configuration can reliably prevent the light from the UV light sources 941 from arriving at the pen tip portions 713 of the pens 71.

It should be understood that the present invention is not limited to the above-described embodiments but may be modified in various manners without departing from the spirit of the invention.

For example, the light irradiation mechanism or finger receiving section may be provided with a movable light-blocking cover, and the light-blocking cover may be moved to or appear at such a position as to surround the exposing window 31*e* of the finger receiving section 31 or near such a position, so that the light irradiation mechanism may perform irradiation with the exposing window 31*e* surrounded by the light-blocking cover.

In the fourth embodiment, the exposing window 31*e* may be provided with a taper inclination part inclined downward and inward, and the light-blocking cover 943 of the light irradiation mechanism 94 may fit into the inclination part. In this case, the lower end part of the light-blocking cover 943 is inserted in the exposing window 31*e* in some degree, which reliably prevents the light from leaking out.

In the second to fourth embodiments, the light irradiation mechanism is attached to the drawing head to move together with the drawing head as one body. The light irradiation mechanism, however, does not necessarily have to be attached to the drawing head to move together with the drawing head as one body.

Alternatively, a mechanism to move only the light irradiation mechanism may be separately provided.

In the embodiments described above, a solenoid is used as the mechanism to move the pens 71 up and down. The configuration of the pen up-and-down mechanism, however, is not limited to this. A step motor, a DC motor, or a motor and ball screw may be used instead to move the pens 71 up and down.

In the embodiments described above, the X-direction movement stage 45 and the Y-direction movement stage 47 to move the drawing head 70 are constituted of the combination of the X-direction movement motor 46 and the Y-direction movement motor 48, which are step motors, and the ball screw and guide (not shown). The configuration to move the drawing head 70, however, is not limited to this.

The drawing head 70 may be moved through any configuration as long as the drawing head 70 can freely move right and left and backwards and forwards. For example, a configuration using a mechanism constituted of shafts, guides, and wires, which are used for typical inexpensive printers; or a configuration using servomotors may be used to move the drawing head 70.

In the first, third, and fourth embodiments, the step motor 731 is used as a means to drive the carriage rotating mechanism 73 to rotate the pen carriage 72 of the drawing head 70. The configuration of the carriage rotating mechanism 73, however, is not limited to this.

For example, the carriage rotating mechanism to rotate the pen carriage of the drawing head may be constituted of a ratchet mechanism, solenoid, or the like.

In the embodiments described above, the shape of a nail T is detected as nail information, and drawing data is generated on the basis of the detected shape. Detection of the nail shape, however, is not essential for the present invention.

In a case in which extraction of the contour of a nail T is not essential, such as a case of drawing a small design mark in the middle of a nail T, accurate recognition of a nail shape is not necessary, and drawing can be performed without the detection of a nail shape.

In the embodiments described above, fingers are inserted in the drawing apparatus 1 one by one so that drawing is performed on the fingers one by one. The present invention, however, may also be applied to a drawing apparatus that can perform drawing on multiple fingers in succession without requiring a user to insert and pull out the fingers one by one.

In this case, for example, the range within which the pens are movable is increased to achieve larger-range drawing, so that the drawing is performed for multiple printing fingers U1 in succession with the printing fingers U1 inserted at a time.

Although various exemplary embodiments of the present invention have been shown and described, the invention is not limited to the embodiments shown but covers the scope of the claims and its equivalents.

What is claimed is:

1. A drawing apparatus comprising:

a drawing head in which at least one drawing tool is held and which performs drawing by applying photocurable fluid material to a drawing target surface of a drawing target object with the drawing tool;

a drawing head movement mechanism to move the drawing head;

a light source unit which emits irradiation light including specific light in a specific wavelength region to cure the photocurable fluid material; and a light-blocking member which is disposed between the light source unit and the drawing tool held in the drawing head and blocks the specific light from arriving at the drawing tool when the light source unit emits the irradiation light, wherein the light source unit is fixed to a position in the drawing apparatus where the light source unit is able to irradiate the drawing target surface with the irradiation light, wherein the light-blocking member is fixed to a predetermined position in the drawing apparatus, and wherein the drawing head movement mechanism: (1) moves the drawing head to a drawing position where the drawing tool is able to perform the drawing on the drawing target surface when the drawing is performed, and (2) moves the drawing head to an escape position where the light-blocking member is located between the light source unit and the drawing tool when the light source unit cures the photocurable fluid material applied to the drawing target surface.

2. The drawing apparatus according to claim 1, further comprising a case containing the drawing head and the light source unit, wherein the case is made of material which can block the specific light in environmental light coming to the case from outside.

3. The drawing apparatus according to claim 1, wherein the drawing target object is a finger or a toe; and wherein the drawing target surface is a surface of a nail of the finger or the toe.

4. A drawing apparatus comprising:

a drawing head which performs drawing by applying photocurable fluid material to a drawing target surface of a drawing target object;

a drawing head movement mechanism to move the drawing head;

a light source unit which emits irradiation light including specific light in a specific wavelength region to cure the photocurable fluid material; and a light-blocking member which is able to block the irradiation light when the light source unit emits the irradiation light, wherein the light source unit is fixed to a position in the drawing apparatus where the light source unit is able to irradiate the drawing target surface with the irradiation light, wherein the light-blocking member is fixed to a predetermined position in the drawing apparatus, and wherein the drawing head movement mechanism: (1) moves the drawing head to a drawing position where the drawing head is able to perform the drawing on the drawing target surface when the drawing is performed, and (2) moves the drawing head to an escape position where the light-blocking member is located between the light source unit and the drawing head when the light source unit cures the photocurable fluid material applied to the drawing target surface.

5. A drawing apparatus comprising:

a drawing head which holds at least one drawing tool and performs drawing by applying photocurable fluid material to a drawing target surface of a drawing target object with the drawing tool;

a placement surface on which the drawing target object is to be placed, a drawing target receiving section which is disposed over the placement surface, into which the drawing target object is to be inserted, and which has an exposing window through which the drawing target surface of the inserted drawing target object is exposed on a side facing the drawing head;

a light source unit which emits irradiation light including specific light in a specific wavelength region to cure the photocurable fluid material; and a cover member which has a shape which is capable of covering the exposing window and is able to block the irradiation light;

wherein the drawing tool includes a tip portion to touch the drawing target surface to apply the photocurable fluid material to the drawing target surface;

wherein the drawing head includes a pressing mechanism which presses the drawing tool along a first direction perpendicular to the placement surface to allow the tip portion to touch the drawing target surface when the drawing is performed, and which lifts the drawing tool along the first direction to separate the tip portion from the drawing target surface when the drawing is not performed;

wherein the light source unit and the cover member are attached to the drawing head and provided so as to be movable along the first direction by the pressing mechanism, wherein when the light source unit emits the irradiation light, the cover member is located at an irradiation position by the pressing mechanism, the irradiation position being a position where the cover member is in contact with the drawing target receiving section and covers the exposing window, and wherein when the light source unit does not emit the irradiation light, the cover member is located at a non-irradiation position by the pressing mechanism, the non-irradiation position being a position where the cover member is separated from the drawing target receiving section.

6. The drawing apparatus according to claim 5, further comprising a drawing head movement mechanism to move the drawing head, wherein the light source unit and the cover member are able to be moved together with the drawing head as one body by the drawing head movement mechanism.

* * * * *